US005870660A

United States Patent [19]

Ito et al.

[11] Patent Number: 5,870,660

[45] Date of Patent: Feb. 9, 1999

[54] HEATING DEVICE

[75] Inventors: Tetsuro Ito, Anjo; Yuusuke Morigami, Toyohashi; Takeshi Kato, Itami; Taizou Oonishi, Toyokawa; Keigo Tange, Okazaki, all of Japan

[73] Assignee: Minolta Co., Ltd., Osaka, Japan

[21] Appl. No.: 919,106

[22] Filed: Aug. 28, 1997

[30] Foreign Application Priority Data

| | | | |
|---|---|---|---|
| Aug. 30, 1996 | [JP] | Japan | 8-229906 |
| Aug. 30, 1996 | [JP] | Japan | 8-229907 |
| Aug. 30, 1996 | [JP] | Japan | 8-229909 |
| Aug. 30, 1996 | [JP] | Japan | 8-230997 |

[51] Int. Cl.[6] ..... G03G 15/20

[52] U.S. Cl. ..... 399/330; 219/619; 399/328

[58] Field of Search ..... 399/328, 330, 399/331, 333; 219/619, 670, 671

[56] References Cited

U.S. PATENT DOCUMENTS

| | | | |
|---|---|---|---|
| 5,526,103 | 6/1996 | Kato et al. | 399/328 |
| 5,568,240 | 10/1996 | Ohtsuka | 399/335 |
| 5,713,069 | 1/1998 | Kato | 399/330 |
| 5,752,150 | 5/1998 | Kato et al. | 399/330 |

FOREIGN PATENT DOCUMENTS

| | | |
|---|---|---|
| 7-114276 | 2/1995 | Japan . |
| 7-253731 | 3/1995 | Japan . |
| 7-295414 | 10/1995 | Japan . |
| 7-319312 | 12/1995 | Japan . |
| 8-006408 | 1/1996 | Japan . |
| 8-016007 | 1/1996 | Japan . |
| 8-044226 | 2/1996 | Japan . |
| 8-044227 | 2/1996 | Japan . |
| 8-063022 | 3/1996 | Japan . |
| 8-129313 | 5/1996 | Japan . |
| 8-129314 | 5/1996 | Japan . |
| 9-096974 | 4/1997 | Japan . |
| 9-127813 | 5/1997 | Japan . |
| 9-134086 | 5/1997 | Japan . |
| 9-197869 | 7/1997 | Japan . |

*Primary Examiner*—Matthew S. Smith
*Attorney, Agent, or Firm*—McDermott, Will & Emery

[57] ABSTRACT

A heating device for use in an induction heating type fixing system is composed of a sleeve 12 made of an electrical conductive material and an electromagnet 13 with a coil 20 and a core 18. It is constructed so as to fulfill the following formulas (1), (2), and (3).

$$S1+S2 \geqq 0.3 \times S3 \quad (1)$$

$$0.2 \leqq S2/(S1+S2) \leqq 0.8 \quad (2)$$

$$1\ \text{mm} \leqq \text{Dmax} \leqq 5\ \text{mm} \quad (3)$$

wherein S1 stands for the cross sectional area of the core 18, S2 for the cross sectional area of the coil 20, S3 for the cross sectional area of the sleeve 12, and Dmax for the maximum distance formed between the outer periphery of the holder 14 and the inner periphery of the sleeve 12.

18 Claims, 20 Drawing Sheets

$$S1 + S2 \geqq 0.3 \times S3 \cdots\cdots (1)$$

$$0.2 \leqq \frac{S2}{S1 + S2} \leqq 0.8 \cdots\cdots (2)$$

$$1mm \leqq Dmax \leqq 5mm \cdots (3)$$

HEATING DEVICE

BACKGROUND OF THE INVENTION

1. Field of the Invention

This invention relates to a heating device for a fixing system for use in such image forming apparatuses as electrophotographic copying machines, printers, and facsimile systems and more particularly to a heating device for use in an induction heating type fixing system for thermally fusing a toner image on a sheet and fixed the toner image on the sheet.

2. Description of the Related Art

Electrophotographic copying machines and other similar apparatuses are provided with a fixing system. The fixing system thermally fuses a toner image transferred on a sheet such as a recording paper or a transfer material, a recording medium and fixed the toner image on the sheet. A halogen lamp heating method such as is used in a heat roller fixing system and a induction heating method such as is used in a film fixing system may be cited as concrete examples of the heating technique used by the heating device in the fixing system. In recent years, the induction heating technique has been attracting attention on account of the advantage that the rate of temperature rise is high.

The film fixing system with the excellent temperature rise characteristics as disclosed in JP-A-07-114,276 and JP-A-08-16, 007 is proposed concerning the conventional fixing systems adopting the induction heating method. The film fixing system is provided with a film as a rotator, an exciting coil disposed on the inner side of the film, and a pressure roller. The film fixing system generates the magnetic flux in the exciting coil to generate an eddy current in the film for induction heating. Then, it causes the sheet to move in concert with the heated film while heating and fusing the toner on the sheet for fixation. In the fixing system disclosed in the patent publications, the rate of temperature rise of the fixing system is heightened by heating only the nip part of the periphery of the film in contact with the pressure roller.

The conventional fixing system is so constructed as to heat the nip part only. Consequently, it must perform both the heating of the film as a rotator and the heat transfer from the film to the sheet within a very small span of time in which the sheet passes through the nip part. A low-speed copying machine or printer may take a relatively long time to pass one sheet through the nip part. It can heat the film in the nip part thoroughly and thus fulfills the desired function of fixing. However, the medium- to high-speed copying machine or printer has to take a relatively short time for the passage of one sheet through the nip part. Namely, it requires to move the sheet and the film at a high speed and is incapable of thoroughly heating the film in the nip part. And it has the possibility of suffering defective fixation particularly on the rear end of the sheet along the direction of conveyance.

SUMMARY OF THE INVENTION

This invention has an object of providing a heating device for use in a fixing system without entailing defective fixation.

It has another object of providing a heating device for use in a fixing system applicable to a medium- to high-speed image forming apparatus.

It has still another object of providing a heating device for use in an induction heating type fixing system applicable to a medium- to high-speed image forming apparatus.

The heating device of this invention for accomplishing the objects comprises a sleeve formed of an electrical conductive material and an electromagnet with a coil and a core, while being constructed so as to satisfy the following formulas (1) and (2).

$$S1+S2 \geqq 0.3 \times S3 \quad (1)$$

$$0.2 \leqq S2/(S1+S2) \leqq 0.8 \quad (2)$$

wherein S1 stands for the cross sectional area of the core, S2 for the cross sectional area of the coil, and S3 for the cross sectional area defined by the inside diameter or the internal surface of the sleeve.

The sectional area of the coil and other similar factors of the heating device are so specified as to fulfill the formulas (1) and (2), the fixing system features high efficiency of heat generation of the sleeve and high rate of temperature rise.

Specifically, the satisfaction of the formula (1) enables the core and the coil to secure an ample total sectional area relative to the cross sectional area of the sleeve for generating a magnetic flux sufficient to heat the entire sleeve.

The satisfaction of the formula (2) allows the core to secure an ample sectional area for forming a sufficient number of turns. The winding for forming the coil, therefore, can be disposed as parallel bundled, lower the resistance per piece of the winding and decrease the current flowing through the winding. As a result, the temperature rise of the coil is retarded and the energy loss (the loss of supplied electric power) resulting from the heat generation is reduced. The satisfaction of the formula (2) allows the inductance of the electromagnet to fall within an adequate range and is helpful in generating the magnetic flux sufficiently. Therefore, the device can be used in a band over the level of audible sound without making any abnormal noise discernible by the user. Further, the core loss is not increased and the thermal efficiency of the sleeve is not lowered.

The fixing system using the heating device of this invention exhibits high thermal efficiency and excels in the temperature rise characteristics. Even when this fixing system is used in a medium- to high-speed image forming apparatus, it is still capable of precluding the possibility of producing defective fixation on the rear end of the recording medium along the direction of conveyance. In this case, the heating device fits the purpose of substantially heating the entire sleeve with the electrical induction and exhibits an excellent thermal efficiency of the sleeve and enjoying a high rate of temperature rise actually. Because the sectional area of the coil and other similar factors are specified so as to satisfy the two conditions.

DETAILED DESCRIPTION OF THE PREFERRED EMBODIMENTS

Now, embodiments of this invention will be described below with reference to the drawings.

First Embodiment

Figure 1:
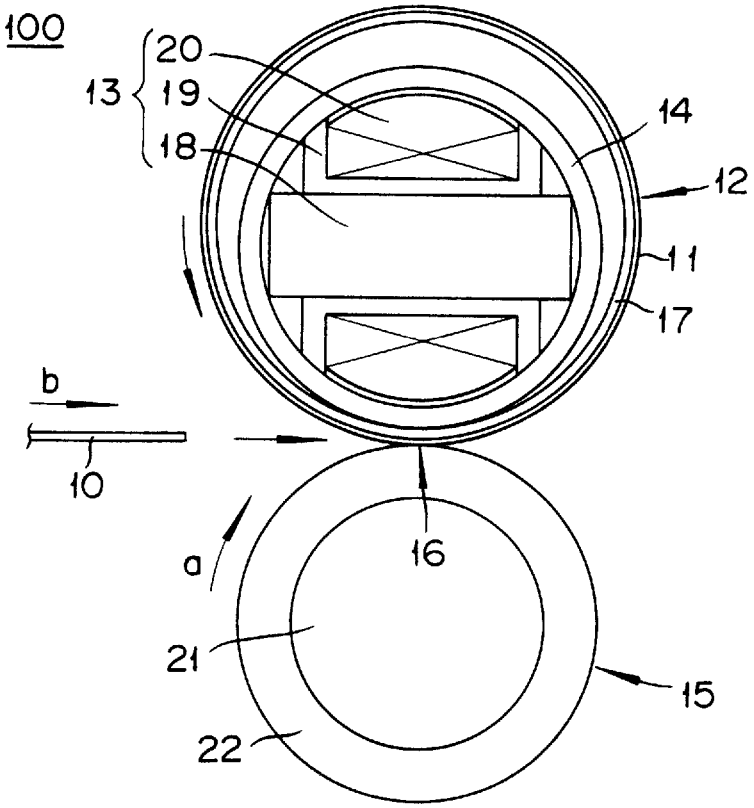
FIG. 1 is a sectional view schematically illustrating the first embodiment of a fixing system with the heating device according to this invention.

FIG. 1 is a sectional view schematically illustrating the first embodiment of a fixing system with a heating device according to this invention.

A fixing system 100 of the first embodiment utilizes induction heating. The induction heating type fixing system is so constructed as to pass a high-frequency current through a coil of an electromagnet to generate a high-frequency magnetic field, induce an eddy current in a sleeve of an electrical conductive material, and rise the sleeve in temperature by Joule heat resulting from skin resistance of the sleeve itself. The induction heating type fixing system of this type has the improved electrothermal conversion efficiency based on the use of the high-frequency induction and may reconcile the energy-saving (low electric power consumption) of the fixing system with the improvement of ease operation (quick print) on the user part.

Specifically, as illustrated in FIG. 1, the induction heating type fixing system 100 is to thermally fuse a toner on a recording medium or a sheet 10 and fix the toner on the sheet 10. This fixing system 100 comprises a sleeve 12 formed of an electrical conductive material, an electromagnet 13 generating an induced current in the sleeve 12 to rise the sleeve 12 in temperature based on induction heating, a holder 14 made of a dielectric material or having insulation properties accommodating the electromagnet 13 and disposed stationarily inside the sleeve 12, and a pressure roller 15 pressed against the holder 14 through the sleeve 12. The sleeve 12 has the surface covered with a release layer 11 with release properties to a toner. The pressure roller 15 nips the sheet 10 with an unfixed toner and moves it together with the sleeve 12. The pressure roller 15 is mounted rotatably in the direction of an arrow a as illustrated in FIG. 1. The sleeve 12 in the shape of a hollow cylinder is nipped between the pressure roller 15 and the holder 14, and is driven to rotate by the rotation of the pressure roller 15.

The sheet 10 with the unfixed toner is conveyed from the direction of left as indicated by an arrow b in FIG. 1. This sheet 10 is forwarded in the direction of a nip part 16 as a contact section between the sleeve 12 and the pressure roller 15. The sheet 10 is nipped and conveyed by the nip part 16 under the heat of the sleeve 12 based on the induction heating and the pressure applied by the pressure roller 15. Consequently, the toner is fixed on the sheet 10 and a fixed toner image is formed on the sheet 10. Besides, the toner is retained on one of the opposite faces of the sheet 10 in contact with the sleeve 12. The sheet 10 which has passed the nip part 16 is spontaneously separated in a curvature radius from the sleeve 12 by dint of the nerve of the sheet itself and conveyed in the direction of right in FIG. 1. This sheet 10 is conveyed by a paper discharging roller (not shown in the diagram) and discharged on an output tray.

The sleeve 12 is a thin-wall hollow metallic conductor with flexibility. A base 17 of the sleeve 12 is preferably formed of such a conductive ferromagnetic material as nickel, iron, or SUS430. Because the sleeve 12 formed of a ferromagnetic member allows much magnetic flux to pass through the inside and enjoys a further improvement in thermal efficiency. The release layer 11 with high releasability to the toner and high-temperature resistance is formed on the outer surface of the base 17 of the sleeve 12 for facilitating the separation of the sheet 10. The release layer 11 composes a coating of fluororesin. The fluororesin is PTFE (polytetrafluorethylene), PFA (perfluoroalkoxy fluororesin), or FEP (ethylene tetrafluoride-propylene hexafluoride copolymer), for example.

The metallic base 17 of the sleeve 12 preferably have a wall thickness in the approximate range of 20 μm–60 μm, for example. As the thickness of the sleeve is decreased, the thermal capacity of the sleeve is proportionately decreased. If the thickness of the sleeve is decreased to excess, the stiffness of the sleeve will be lowered, and the sleeve becomes fragile and poses the problem of durability. Further, it is difficult to produce the sleeve with a uniform thickness and the cost of production increases. Conversely, if the thickness of the sleeve is increased to excess, the bending force resistance of the sleeve will be lowered and the sleeve loses flexibility. It becomes difficult to impart a partial change to the curvature radius of the sleeve for the formation of the nip part with a large width. And the production requires a large amount of the material and the cost of material rises. The time referred to as "quick fixation" is generally preferred to be within 10 seconds of starting the power supply. In brief, the fixing system is required to elevate the temperature of the sleeve to a range appropriate for the fixation (180° C.–200° C., for example) within this span of 10 seconds.

Accordingly, the temperature rise characteristics was checked with sleeves using a base 17 of a various wall thickness in an experiment. As a result, it was found that the temperature of the sleeve did not reach the desired fixing level even after the elapse of the allowable time limit (10 seconds) for "quick fixation" when the wall thickness of the base 17 was 15 μm under 20 μm. The reason for the elongation of the warm-up time is that the sleeve is deficient in the absorption of electric power and in the efficiency of electrothermal conversion. W hen the wall thickness of the base 17 was 65 μm over 60 μm, the thermal capacity of the sleeve was increased by t he increase of the wall thickness and the temperature of the sleeve could not be elevated to the desired fixing level with in the allowable time limit. In consideration of the results of this experiment and the problems pertaining to the production, the base 17 of the sleeve 12 preferably has a thickness in the approximate range of 20 μm–60 μm. In short, by setting the wall thickness of the base 17 within 20 μm–60 μm, the excellent fixing system 100 can be realized in terms of durability, temperature rise characteristics, and cost.

The electromagnet 13 generating a high-frequency magnetic field is disposed inside the sleeve 12 to induce an eddy current in the sleeve 12 for heating up the sleeve 12 based on Joule heat. This electromagnet 13 is retained inside the holder 14. The holder 14 is fixed to a frame of the fixing system (not shown in the diagram) and deprived of freedom of rotation. Further the holder 14 is provided at the opposite ends with flanges (not shown) for restraining the sleeve 12 from deviating in the longitudinal direction of the holder 14.

The electromagnet 13 comprises a core 18 of a magnetic material in the shape of a letter I, and an induction coil 20 formed by winding a wire round the core 18. The electromagnet 13 is so constructed as to generate a magnetic flux capable of inducing an eddy current in the nip part 16 and the other area of the sleeve 12. In the present embodiment, the electromagnet 13 further comprises a bobbin 19 with a central through hole. The coil 20 is formed by winding a copper wire a plurality of turns around this bobbin 19. The core 18 is inserted into the through hole of the bobbin 19 so as to intersect perpendicularly the copper wire of the coil 20. In the holder 14 formed separately of the bobbin 19, the electromagnet 13 is accommodated in such a manner that the core 18 may be parallel to the direction of conveyance of the sheet. The electromagnet 13 is held in the holder 14 so as not to be exposed to the outside.

The core 18 is formed of a ferrite core or a laminate core, for example. The core 18 has a simple shape of a letter I. It is produced at a low cost and inserted into the through hole of the bobbin 19 by a simple work. The electromagnet 13 is retained in the holder 14 and the end face of the core 18 in the longitudinal direction of its cross section approximates closely to the inner wall of the holder 14. When the core 18 is disposed in this manner, the distance between the core 18 and the sleeve 12 is narrowed and the magnetic linkage of the core with the sleeve 12 is strengthened and, thus the power transmission is attained at a high efficiency. Optionally, the end face of the core 18 may be given an arcuate contour which conforms to the inner face of the holder 14.

The bobbin 19 rises in temperature by the heat of the induction coil 20 and the heat transfer from the surrounding region. Consequently, the bobbin 19 requires such resistance as endures at least the fixing temperature, namely the surface temperature of the sleeve 12. The bobbin 19 is formed of a ceramic material, or an engineering plastic material with high-temperature resistance and electrical insulation properties. PPS (polyphenylene sulfide), PEEK (polyether ether ketone), LCP (liquid crystal polymer), phenol, etc. may be cited as concrete examples of the engineering plastic materials.

The copper wire composed of the coil 20 is preferably a simple or litz copper wire with a fused layer and an insulating layer on the surface. Incidentally, the holder 14 is formed of an insulating material in a desired shape as will be specifically described herein below.

The electromagnet 13 is provided with the bobbin 19 wound with a copper wire. The work for manufacturing the coil is facilitated and the wire is stably wound. The bobbin 19 functions as an insulating medium for electrically insulating the core 18 from the induction coil 20. Namely, the bobbin 19 ensures the electrical insulation between two components 18 and 20. For that reason, the fixing system 100 suffers only sparing occurrence of trouble and enjoys high reliability.

The pressure roller 15 comprises a core 21 and a silicone rubber layer 22 formed on the core 21. The silicon rubber layer 22 is composed of a rubber layer with high-temperature resistance and releasing properties for allowing easy separation of the sheet 10 from the surface. Slip bearings (not shown in the diagram) are formed at the opposite ends of the pressure roller 15. The slip bearings are rotatably mounted to the frame of the fixing frame. The pressure roller 15 is pressed by a spring (not shown in the diagram) toward the holder 14 across the sleeve 12. A drive gear (not shown in the diagram) is fixed to one end of the pressure roller 15 and is rotated by a drive source (not shown in the diagram) such as a motor connected to the drive gear.

The fixing system 100 comprises a temperature sensor (not shown) which is composed of a thermistor, for example, and disposed so as to be pressed against the outer or inner surface of the sleeve 12 for the detection of the temperature of the sleeve 12. In short, the temperature sensor detects the temperature of the sleeve 12 and regulates the power supply to the induction coil 20 so as to optimize the temperature of the sleeve 12.

Figure 2:
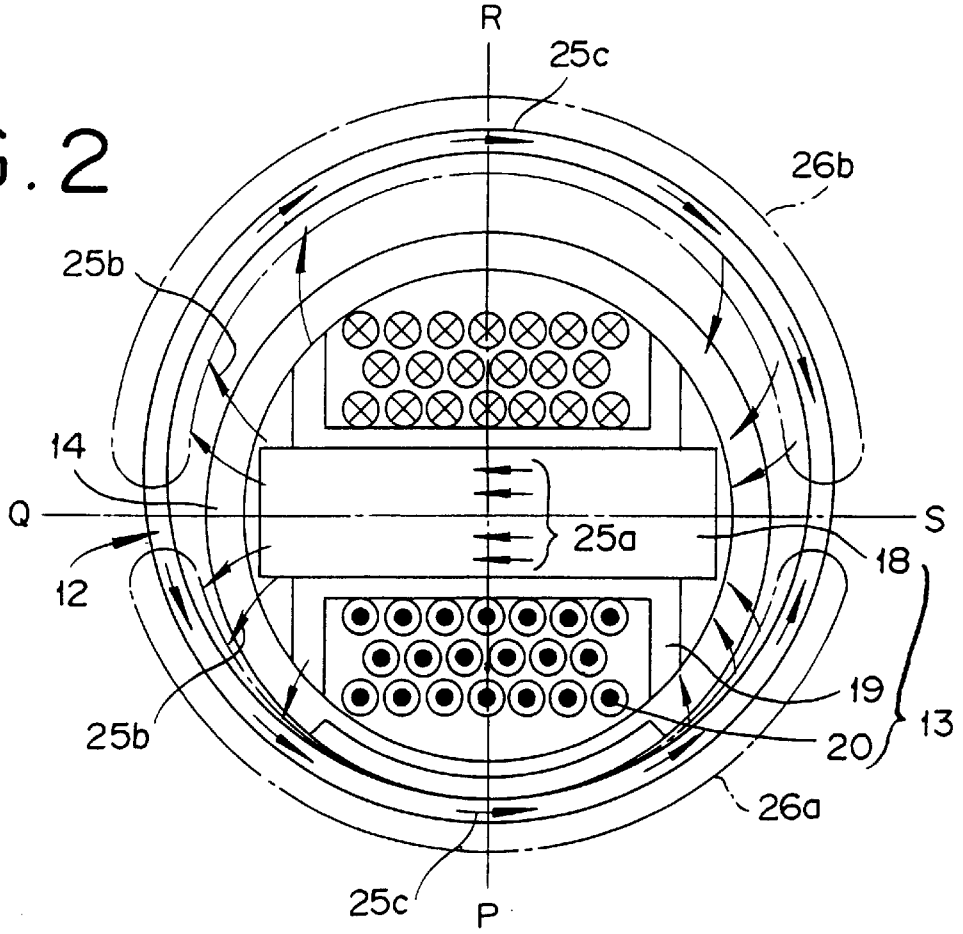
FIG. 2 is an explanatory diagram for illustrating the principle of heating the sleeve in the fixing system of the first embodiment.

FIG. 2 is an explanatory diagram for illustrating the principle of heating the sleeve 12 in the induction heating type fixing system 100. When an electric current of high frequency (several kHz to some tens of kHz) is supplied to the coil 20, the core 18 generates magnetic flux 25*a* perpendicular to the direction of the longitudinal axis of the sleeve 12 in accordance with the "Ampere's right-hand screw rule". The magnetic flux 25*a* is also high-frequency.

Magnetic flux 25*b*, after reaching the sleeve 12 as a conductor, is bent along the sleeve 12 and converted, at a ratio depending on the relative permeability of the conductor, into magnetic flux 25*c* which passes inside a shell of the sleeve 12. The magnetic flux 25*c* concentrated on the shell of the sleeve 12 has the maximum density in the part opposed to the coil 20.

By concentrating magnetic flux 25*c*, the sleeve 12 is caused to generate an induced current obstructing the magnetic flux 25*c* in accordance with the "Lenz's law". In other words, the sleeve 12 generates inside, such an eddy induced current as produces magnetic flux in the direction opposite that of the magnetic flux 25*c*. This induced eddy current is converted into Joule heat by the skin resistance of the sleeve for heating the sleeve 12. Incidentally, the electromagnet 13 is disposed inside the sleeve 12. And the inner side of the sleeve 12 is more liable to generate heat by the skin effect than the outer side.

In the construction, the magnetic flux density in the shell of the sleeve 12 is maximized at the point P and R and conversely minimized at the point Q and S. Since the induced current density follows the same trend, the heat generation inside the sleeve 12 is not uniform in the circumferential direction of the shell but is maximized at the points P, R and localized in sections 26*a*, 26*b* enclosed with a two-dot chain line. The sections 26*a*, 26*b* in which the heat is locally generated, correspond to the upper area and the lower area of the sleeve 12 in the diagram of FIG. 1. As a result, the nip part 16 and either of the heat generation areas overlap at least partly. In the first embodiment, since the core 18 enclosed by the coil 20 is disposed parallel to the direction of conveyance of the sheet 10, one of the heat generation areas in the sleeve 12 and the nip part 16 may overlap each other. The heat of the sleeve 12 is thoroughly transferred to the toner without loss.

The sleeve 12, as illustrated in FIG. 2, has the maximum points of heat generation P and R at two places along the circumferential direction. When this fact is viewed from the coil side, the coil 20 induces an eddy current in the sleeve 12 such that the sleeve 12 may possess two maximum points of heat generation P and R.

Figure 3:
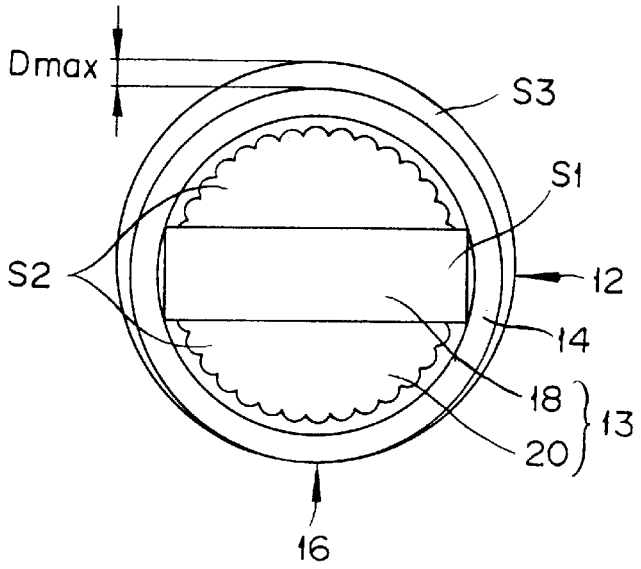
FIG. 3 is the diagram of an artist's concept for facilitating the comprehension of the formulas (1), (2), and (3) satisfied by the heating device of the first embodiment.

The heating device of the first embodiment is constructed so as to satisfy the following three formulas FIG. 3 is a diagram depicting an artist's concept for facilitating the comprehension of these formulas. FIG. 3 omits the bobbin 19 because the bobbin 19 is not an indispensable component for the construction of the electromagnet 13.

$$S1+S2 \geqq 0.3 \times S3 \quad (1)$$

$$0.2 \leqq S2/(S1+S2) \leqq 0.8 \quad (2)$$

$$1\ \text{mm} \leqq \text{Dmax} \leqq 5\ \text{mm} \quad (3)$$

wherein S1 stands for the cross sectional area of the core 18 concerning a plane perpendicular to the axis of the holder 14, S2 for the cross sectional area of the induction coil 20 concerning a plane perpendicular to the axis of the holder 14, S3 for the cross sectional area of the sleeve 12 concerning a plane perpendicular to the axis of the holder 14, and Dmax for the maximum gap or maximum distance formed between the outer periphery of the holder 14 and the inner periphery or the internal surface of the sleeve 12.

Now, the formulas will be described below in the order of their occurrence above.

[Re: Formula (1)]

Formula (1) defines the ratio of the cross sectional areas of the coil 20 and the core 18 to the cross sectional area of the sleeve 12 concerning the plane perpendicular to the axis of the holder 14. For the sake of convenience of the description, the coil 20 and the core 18 will be collectively referred to as "coil-core."

Figure 4:
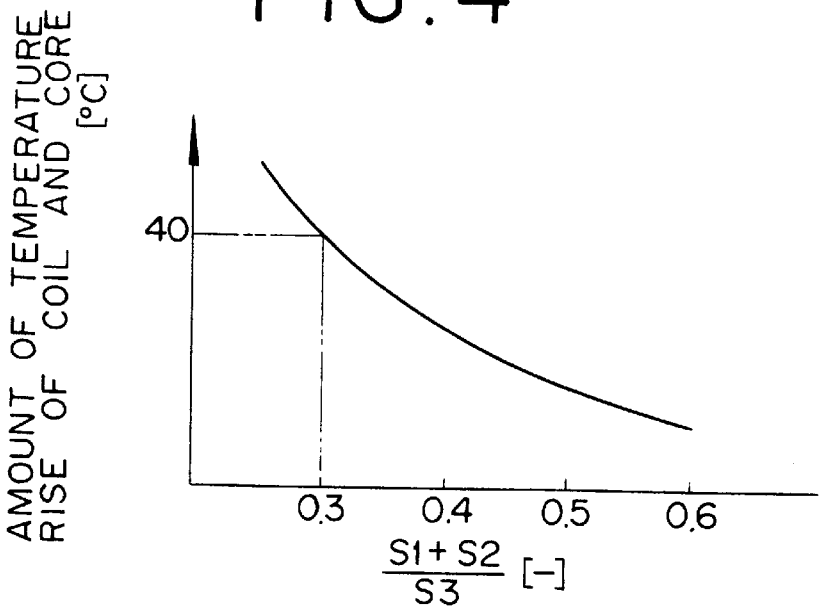
FIG. 4 is a graph for illustrating the formula (1)

FIG. 4 is a graph for illustrating Formula (1). In this graph, the horizontal axis indicates the ratio (S1+S2)/S3 and the vertical axis the temperature rise of the coil-core (°C.) . When the heat generation in the sleeve 12 is inefficient relative to the electric power supplied to the coil 20, the energy loss generates heat inside the coil-core and the coil-core heats up. Namely, the vertical axis indicates the level of energy loss.

The energy loss was measured under the following test conditions. Electric power of 750 W was supplied, standard A4 papers (64 g/m$^2$) were continuously fed laterally at a rate of 30 sheets/minute and the temperature differential or the temperature rise of the coil-core ΔT was measured as the energy loss. In addition, AIW (amide imide wire) having a heat-resistance temperature of 220° C. was adopted from the viewpoint of economy as the copper wire composed of the induction coil 20. The fixing temperature was set in a standard range of 150° C.–180° C.

The test result of the energy loss under the conditions is as shown in FIG. 4. It is clearly noted from this diagram that the energy loss is increased by the insufficient generation of magnetic flux in accordance as the ratio of the cross sectional area of the coil-core to the cross sectional area of the sleeve 12) or (S1+S2)/S3 is decreased. When the temperature rise of the coil-core exceeds 40° C. (220° C.–180° C.), the temperature of the coil-core inevitably surpasses the heat-resistance temperature of AIW.

For generating the magnetic flux sufficiently, lowering the energy loss and preventing the coil-core from heating up over the heat-resistance temperature of the AIW, the ratio of the cross sectional area of the coil-core to the cross sectional area of the sleeve 12 or (S1+S2)/S3 is required to be not less than 0.3. Thus, the following formula must be fulfilled.

$$S1+S2 \geqq 0.3 \times S3 \quad (1)$$

By constructing the electromagnet 13 so as to satisfy this formula (1), the cross sectional areas of the core 18 and the coil 10 can be amply secured relative to the cross sectional area of the sleeve 12, and the magnetic flux necessary for heating the entire sleeve 12 can be amply generated.

[Re: Formula (2)]

Formula (2) defines the ratio of the cross sectional area of the coil 20 to the cross sectional area of the coil-core concerning the plane perpendicular to the axis of the holder 14.

Figure 5:
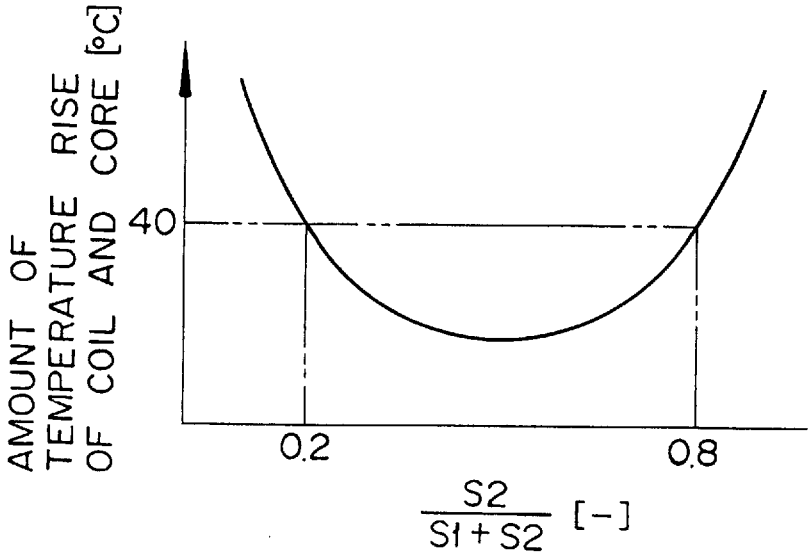
FIG. 5 is a graph for illustrating the formula (2)

FIG. 5 is a graph for illustrating Formula (2). In this graph, the horizontal axis indicates the ratio, S2/(S1+S2) and the vertical axis the temperature rise of the coil-core [°C.]. Similarly to the graph of FIG. 4, the vertical axis means the energy loss.

The energy loss under the conditions shown in Formula (1) was measured. The test result is as shown in FIG. 5. It is clearly noted from this diagram that the energy loss is minimized when the ratio of the sectional area of the coil 20 to the sectional area of the coil-core or S2/(S1+S2) is about 50%, and the energy loss is grown when the ratio was increased or decreased from this minimum level. And the temperature of the coil-core inevitably surpasses the heat-resistance temperature of AIW when the temperature rise of the coil-core exceeds 40° C.

If the sectional area of the coil 20 is unduly large (the cross sectional area of the core 18 is consequently unduly small), the self-inductance increases, the working frequency band falls, and the generation of audible sound occurs. Because the self-inductance is proportional to the square of the number of turns of the coil. The cross sectional area of the coil 20 is large and the resistance of the coil is lowered. However, the working frequency band is also lowered and the duration in which the current passing to the coil in one direction is prolonged. As a result, the effective current is enlarged and the copper loss of the coil 20 is increased.

Conversely, if the cross sectional area of the coil 20 is unduly small (or the cross sectional area of the core 18 is consequently unduly large), the self-inductance decreases for the reason given above and the working frequency band rises. Consequently, the iron loss of the coil 20 and the core 18 increases and the circuit loss in the oscillation circuit increases.

Incidentally, the Lenz's law or $e=-L\cdot(\Delta I/\Delta t)$ is applied to the relation between the inductance and the working frequency band. In short, for adjusting the electromotive force e at a target value, the ratio $\Delta I/\Delta t$ (change of current relative to time=oscillation frequency) is decreased when the inductance L is large and conversely the ratio $\Delta I/\Delta t$ is increased when the inductance L is small. As a result, the working frequency band falls as the self-inductance increases, and the working frequency band rises as the self-inductance decreases in the same way.

For controlling the inductance of the coil-core in an adequate range, decreasing the energy loss, and preventing the temperature from rising over the heat-resistance temperature of the AIW, the ratio of the cross sectional area of the coil 20 to the cross sectional area of the coil-core or S2/(S1+S2) be not less than 0.2 and not more than 0.8. It is found from the data that the following formula must be fulfilled.

$$0.2 \leqq S2/(S1+S2) \leqq 0.8 \quad (2)$$

The fulfillment of the Formula (1) means the increase of the magnetic flux, the increase of electric current, and the temperature rise of the coil 20. By constructing the electromagnet 13 so as to fulfill the Formula (2), the coil 20 may have an ample cross sectional area and an ample number of turns. The wiring forming the coil 20 can be disposed as parallel bundled, the resistance per one wiring can be lowered, and the electric current passing through the coil can be decreased. As a result, the temperature rise of the coil 20 can be retarded and the energy loss (supplied electric power) in consequence of the heat generation can be reduced.

By the further fulfillment of the Formula (2), the inductance of the electromagnet 13 is controlled in an adequate range. Also from this point of view, it is made possible to generate the magnetic flux amply, attain the use above the range of audible sound, and eliminate the noise. Moreover, the core loss of the core 18 is not increased and the sleeve 12 is prevented from the decline of the thermal efficiency.

[Re: Formula (3)]

Formula (3) is a conditional formula applied to the case in which the holder 14 and the sleeve 12 both have a cylindrical shape substantially and the holder 14 is mounted as held in contact with the inner face of the sleeve 12. The Formula (3) defines the maximum distance formed between the outer periphery of the holder 14 and the internal surface or inner periphery of the sleeve 12.

Figure 6:
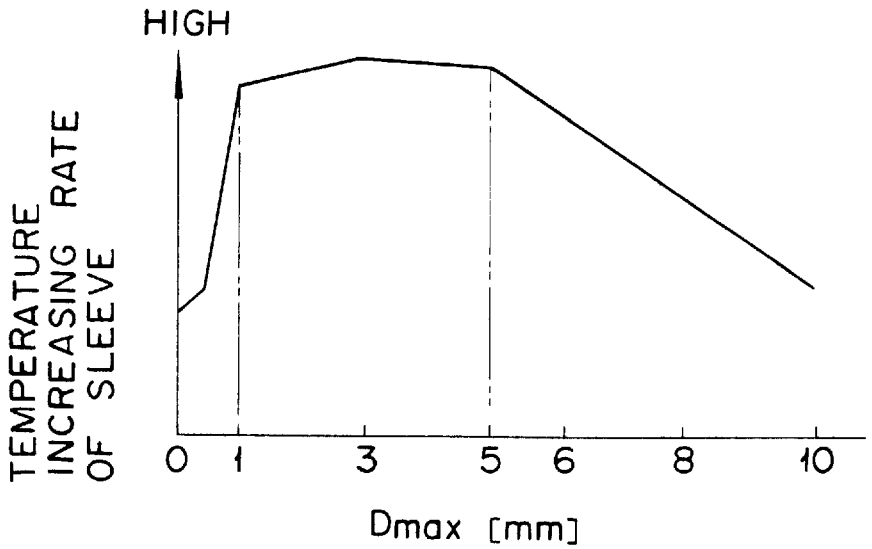
FIG. 6 is a graph for illustrating the formula (3)

FIG. 6 is a graph for illustrating the Formula (3). In this graph, the horizontal axis is the scale of the maximum distance Dmax and the horizontal axis the scale of the rate of temperature rise of the sleeve 12.

The rate of temperature rise of the sleeve 12 was measured while changing the maximum distance. The test result is shown in FIG. 6. It is clearly noted from the diagram that the rate of temperature rise of the sleeve 12 sharply declines when the gap distance formed between the outer periphery of the holder 14 and the inner periphery of the sleeve 12 increases past 5 mm. The reason for this sharp decline is that the linkage of the magnetic circuit generated between the sleeve 12 and the coil-core is weakened and the thermal efficiency is lowered. From the viewpoint of fortifying the linkage of the magnetic circuit between the sleeve 12 and the coil-core, it is only necessary to decrease the distance between the components 12 and 14 to the fullest possible extent. Namely, the sleeve 12 quickly generates heat when the gap distance decreases below 1 mm. However, the area in which the sleeve 12 comes in contact with the outer periphery of the holder 14 increases and the greater part of the heat of the sleeve 12 transfers to the holder side. Thus, the rate of temperature rise of the sleeve 12 is lowered sharply.

It is found that for appropriately maintaining the rate of temperature rise of the sleeve 12, the gap distance or Dmax formed between the outer periphery of the holder 14 and the inner periphery of the sleeve 12 must be not less than 1 mm and not more than 5 mm. Namely the following formula must be fulfilled.

$$1\ \text{mm} \leqq \text{Dmax} \leqq 5\ \text{mm} \quad (3)$$

By securing an adequate distance between the sleeve 12 and the holder 14 other than the nip part 16 for fulfilling the Formula (3), the heat transfer of the sleeve 12 toward the holder side can be restrained and the decline of the rate of temperature rise of the sleeve 13 can be prevented. Further, it eliminates the possibility that the temperature control of the sleeve 12 becomes unstable.

[Operation]

Figure 7A:
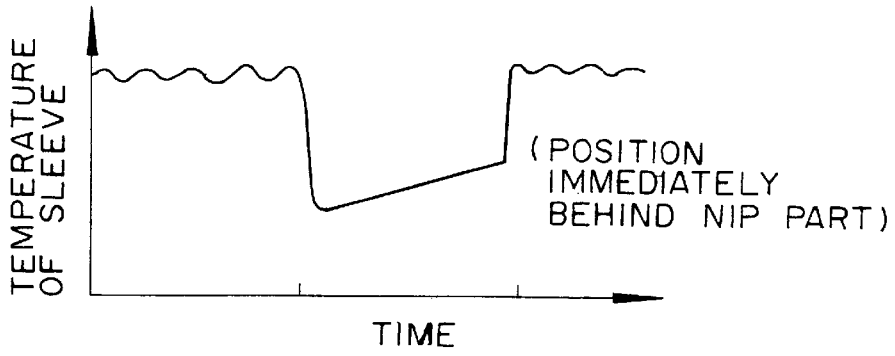
FIGS. 7A–7D are graphs for illustrating the operation of the first embodiment.
Figure 7B:
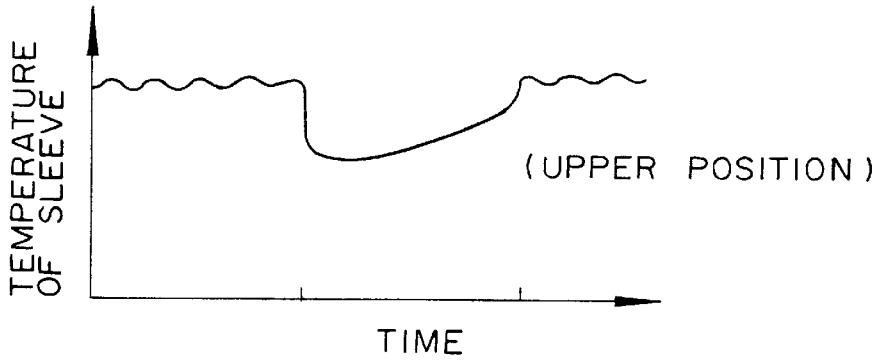
Figure 7C:
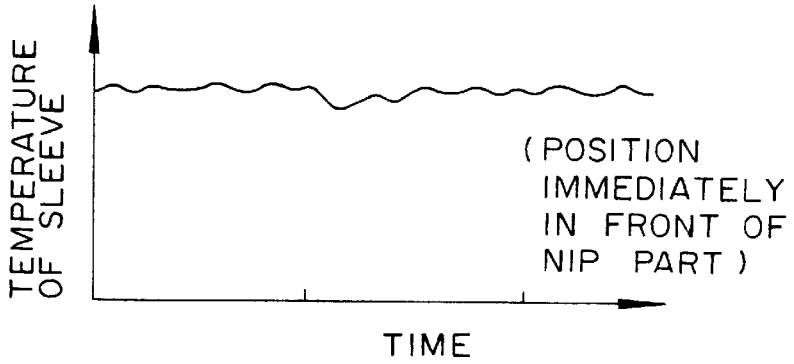
Figure 7D:
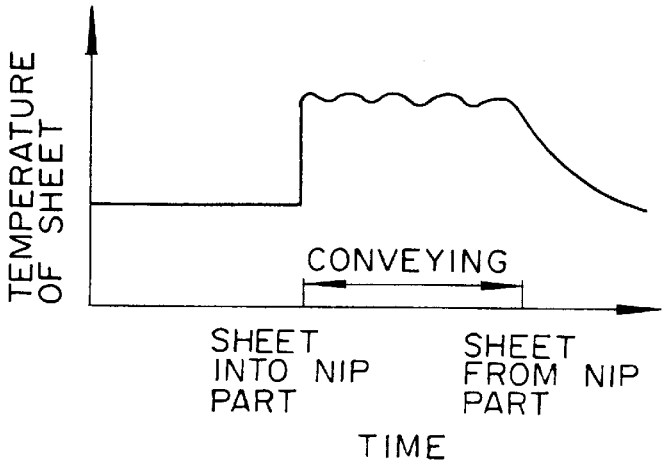

Now, the operation of the present embodiment will be described below. FIGS. 7A–7D are diagrams for illustrating the operation of the first embodiment. FIGS. 7A–7C respectively represent the temperature changes of the sleeve at the position closely behind the nip part, the upper position on the side opposite the nip part, and the position contiguously in front of the nip part. FIG. 7D represents the temperature change of the sheet. The test conditions were the same as indicated in connection with the Formula (1).

In the first embodiment, the opposite ends of the core 18 surrounded by the induction coil 20, is disposed closely to the sleeve 12 and the electromagnet 13 generates the magnetic flux to induce an eddy current in the nip part 16 and the area other than the nip part 16 of the sleeve 12. The magnetic flux causes induction heating in the entire sleeve 12 substantially to heat the sleeve 12 up to the predetermined fixing temperature.

The sleeve 12 and the sheet 10 come into contact each other and the heat of the sleeve 12 is transferred to the sheet 10 and the toner when the leading end of the sheet 10 is thrust into the nip part 16. The temperature of the sleeve 12 is widely lowered at the position closely behind the nip part 16 as illustrated in FIG. 7A.

The sleeve 12 rotated in consequence of the conveyance of the sheet 10 is substantially subjected to the induction heating entirely. The sleeve 12 begins to heat up immediately after the temperature is lowered at then nip part 16. Therefore, the temperature of the sleeve 12 is higher, if not so much as to surpass the fixing temperature, at the upper position on the side opposite the nip part 16 than at the position directly behind the nip part 16 as shown in FIG. 7B.

The sleeve 12 is further kept under induction heating with rotating. Then, the sleeve 12 has resumed the predetermined fixing temperature at the position closely in front of the nip part 16 as shown in FIG. 7C.

The temperature of the sheet 10 is substantially uniform even when the sheet 10 is conveyed at such a relatively medium to high speed as 30 sheets per minute as shown in FIG. 7D. When the fixing system 100 is applied to a medium- to high-speed image forming apparatus, there is no possibility that the sleeve 12 is insufficiently heated in the nip part 16 and the defective fixation of the toner is occurred on the rear end of the sheet 10 along the direction of conveyance.

In the electromagnet 13 of the first embodiment, the opposite ends of the core 18 surrounded by the coil 20 are disposed so as to approximate as closely to the fixing sleeve 12 as permissible. The magnetic linkage between the fixing sleeve 12 and the electromagnet 13 is amply secured and the thermal efficiency and the magnetic linkage force are not decreased. The electromagnet 13 is so constructed as to fulfill the Formulas (1), (2). Thus, the electromagnet 13 generates a magnetic flux amply and also converts the magnetic flux efficiently into heat inside the sleeve 12. The fixing system 100 is so constructed as to fulfill the Formula (3). Hence, the sleeve 12 is prevented from the heat transfer. And the thermal efficiency of the fixing system 100 is improved and the rate of temperature rise of the sleeve 12 increases.

[Re: Material of Holder]

The induction heating type fixing system requires a holder in the shape of a thin-walled pipe with high-temperature resistance and high stiffness to be stably controlled at the fixing temperature. In the first embodiment, the holder 14 is formed of a fiber-reinforced thermosetting resin and, after the forming, further subjected to a hardening treatment at a temperature exceeding the fixing temperature.

The deformation (plastic deformation) under continuous heating was measured as to three sample holders formed of a thermoplastic resin, a thermosetting resin, and a fiber-reinforced thermosetting resin respectively. The test conditions are as follows.

Inside diameter of sleeve: ϕ 40 mm (30 $\mu$m in wall thickness)

Outside diameter of holder: ϕ 38 mm (3.5 mm in wall thickness)

Fixing temperature: 150° C.

Pressure applied: 10 kgf/cm$^2$ wherein PEEK was adopted as the thermoplastic resin, phenol resin (fillerless) as the thermosetting resin, and phenol resin (containing glass fibers) as the fiber-reinforced thermosetting resin. The test result is shown in Table 1. A case that a holder deformation exceeds 0.1 mm is mentioned as "X" (rejectable) Because the rotation of sleeve and the conveyance of sheet are hindered. A case that a holder deformation is less than 0.1 mm is referred to "○" (acceptable). The sample holders made of the thermosetting resin and the fiber-reinforced thermosetting resin were each prepared in three types, a) holders not hardened, b) holders hardened at a temperature lower than the fixing temperature, and c) holders hardened at a temperature exceeding the fixing temperature.

TABLE 1

| Material for holder | | | Rate |
|---|---|---|---|
| Thermoplastic resin | | | × |
| Thermosetting resin | a | Not hardened | × |
| | b | Hardened at low temperature under fixing temperature | × |
| | c | Hardened at high temperature over fixing temperature | × |
| Fiber-reinforced thermosetting resin | a | Not hardened | × |
| | b | Hardened at low temperature under fixing temperature | × |
| | c | Hardened at high temperature over fixing temperature | ○ |

Though the holders were extrusion molded, the temperatures of the resins during the molding were not so high as the fixing temperature in consideration of such factors as the accuracy of manufacturing. It is clearly noted from Table 1 that, when the holder 14 has been subjected to a hardening treatment at a temperature higher than the working temperature (fixing temperature), the holder 14 made of the fiber-reinforced thermosetting resin acquires enhanced stiffness by accelerating the reaction of unaltered cross-linked part of the thermosetting resin at the temperature. In particular, the deformation of the holder 14 made of the fiber-reinforced thermosetting resin decreases to 1/10 after the hardening treatment.

The fixing system 100 of the first embodiment adopts the electromagnetic induction heating. Thus, the holder 14 accommodating the electromagnet 13 inside is required to be an insulator to prevent the sleeve 12 and the coil 20 from a short-circuit. This requirement explains the adoption of the holder made of a resin which maybe accurately molded. A holder made of glass may be adapted for use instead of resin. However, the glass holder is inferior to the resinous holder in terms of the stiffness against oscillation and the precision of straightness.

[Re: Shape of Holder]

Figure 8A:
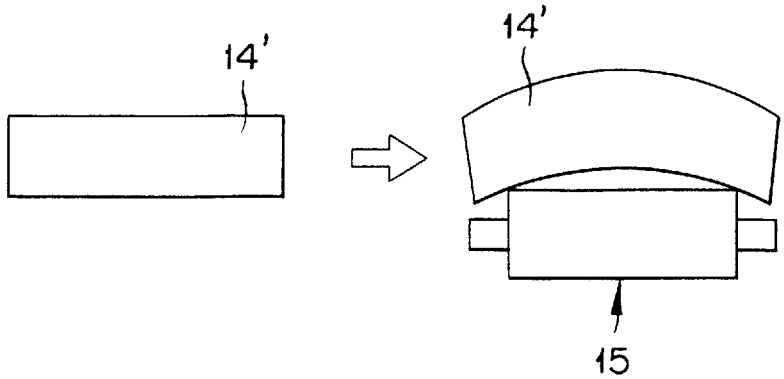
FIGS. 8A and 8B are diagrams of an artist's concept of the shape of a holder in the first embodiment.

The holder 14' is made of the fiber-reinforced thermosetting resin and subjected to the hardening treatment at the temperature higher than the fixing temperature after the shaping, as shown in FIG. 8A, However, the holder 14' has the possibility of making a bend under heating and pressure condition that the fixing system is in the process of operation. The metallic sleeve 12 assumes the shape of a straight pipe. A space can be formed between the metallic sleeve 12 and the bent holder 14' at the nip part 16. And the space can produce defective rotation or breakage of the sleeve 12 or defective conveyance of the sheet 10.

Figure 8B:
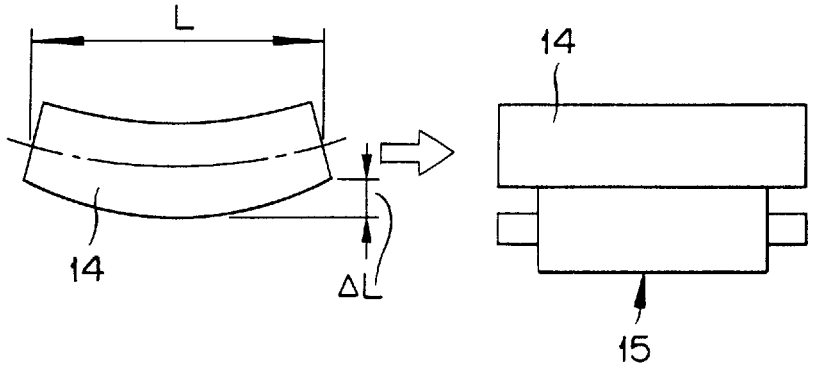

The holder 14 of the first embodiment is subjected to the hardening treatment and molded as an arcuate shape convexed toward the pressure roller 15 as illustrated in FIG. 8B. In other words, the holder 14 is molded preparatorily in the arcuate shape such that the face of the holder 14 opposite to the pressure roller 15 may be parallel to the sleeve 12 when the holder is pressed, or pressed and heated. For example, the holder length L is 33 cm and the bending factor ΔL is in the range of 0.05 mm–0.1 mm when the holder is pressed in the approximate range of 5 kgf/cm$^2$ to 15 kgf/cm$^2$.

By molding the holder 14 in the shape, the bending of the holder 14 formed during the operation of the fixing system can be compensated. There is no possibility that a space will be formed in the nip part 16 between the sleeve 12 and the holder 14 and the sleeve 12 will suffer defective rotation or fracture and the sheet 10 will produce defective conveyance.

Second Embodiment

Figure 9:
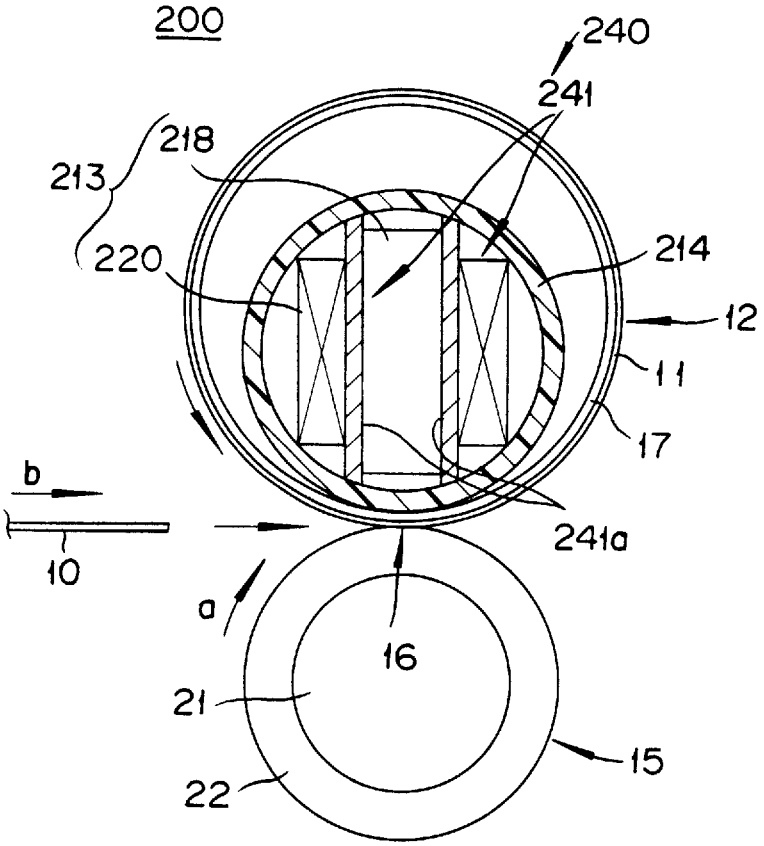
FIG. 9 is a sectional view schematically illustrating a fixing system according to the second embodiment.

FIG. 9 is a sectional view schematically illustrating a fixing system 200 according to the second embodiment. In this diagram, like members found in FIG. 1 are denoted by like reference numerals and these members will be partly omitted from the following description.

The fixing system 200 of the second embodiment adopts the induction heating, similarly to the fixing system of the first embodiment. It is constructed to fulfill the following formulas.

$$S1+S2 \geqq 0.3 \times S3 \quad (1)$$

$$0.2 \leqq S2/(S1+S2) \leqq 0.8 \quad (2)$$

$$1\ \text{mm} \leqq \text{Dmax} \leqq 5\ \text{mm} \quad (3)$$

The fixing systems according to the third through the eighth embodiments to be described herein below are so constructed as to fulfill these three conditions.

The fixing system 200 of the second embodiment is particularly provided with a supporting member 240 which supports against the pressure from the pressure roller 15 to strengthen the stiffness of a holder 214. The supporting member 240 is composed of a pair of support plates 241 which are disposed between a core 218 and an induction coil 220.

To be more specific, an electromagnet 213 of the second embodiment has the coil 220 formed by winding a copper wire a plurality of turns around the pair of support plates 241. The core 218 is inserted between the pair of support plates 241 in such a manner as to perpendicularly intersect the copper wire of the coil 220. The electromagnet 213 is retained inside the holder 214 made of a resinous material in such a manner that the longitudinal direction of the cross section of the core 218 is perpendicular to the direction of conveyance of the sheet and the core 218 is not exposed to the outside.

The core 218 is formed of a ferrite core or a laminate core, for example. The core 218 is produced at a low cost and disposed between the pair of support plates 241 by a simple work, because the core 218 has a simple shape of a letter I. The end face of the core 218 in the longitudinal direction of its cross section approximates closely to the inner wall of the holder 214 when the electromagnet 213 is retained in the holder 214. The arrangement of the core 218 narrows the air gap or the distance between this core 218 and the sleeve 12 and strengthens the magnetic linkage of the core 218 with the sleeve 12. Thus, the efficiency of electric power transmission becomes high. Optionally, the end face of the core 218 may be formed to be in the shape of an arcuate contour which conforms to the inner face of the holder 214.

The holder 214 is heated up by the heat from the induction coil 220 and the heat conducted from the surrounding region. Thus, the holder 214 requires to have such high-temperature resistance as endures at least the fixing temperature, namely the surface temperature of the sleeve 12. The fixing system 200 adopts electromagnetic induction heating. Consequently, the holder 214 accommodating the electromagnet 213 requires to be an insulator for preventing the sleeve 12 and the coil 220 from a short-circuit. This requirement explains the adoption of a holder made of a resinous material which may be accurately molded. And a thermosetting resin such as phenol resin (fillerless) is appropriate to be used as the resinous material in consideration of the high-temperature resistance and insulating properties.

The copper wire composed of the coil 220 is preferably a simple or litz copper wire covered on the surface with a fused layer and an insulating layer.

The supporting plates 241 are formed in a simple platelike shape having a length substantially equal to the axial length of the holder 214 respectively. And the supporting plates 241 comprise elongated parts 241*a* extending substantially parallel to the direction in which the pressure roller 15 comes in contact with the holder 214. The elongated parts 241*a* are so disposed as be parallel to the magnetic flux generated by the electromagnet 213. Namely, the heat generation in the elongated parts 241*a* and the loss of the magnetic flux increase and the thermal efficiency of the sleeve is lowered when the elongated part 241*a* is disposed so as to intersect perpendicularly the magnetic flux. In the construction illustrated in FIG. 9, the elongated part 241*a* extends in the vertical direction in the diagram, and the upper end and the lower end of the elongated part 241*a* collide the inner periphery of the holder 214. The supporting plates 241 are formed of a material with nonmagnetic properties. It is suitable that relative permeability of the material is about 1. In particular, the supporting plates 241, may be formed of aluminum, silver, copper, SiO2, ceramic materials, and SUS304.

The opposite ends of the holder 214 keeping the electromagnet 213 inside are fixed to such a rigid structure as the frame of a fixing system or the frame of an image forming apparatus (not shown in the diagram).

In the second embodiment with the supporting member 240, the pressure applied from the pressure roller 15 to the holder 214 via the sleeve 12 is maintained by the supporting plates 241 disposed along the direction in which the pressure is exerted, particularly by the elongated parts 241*a* of the supporting plates 241. Thus, the stiffness of the holder 214 is substantially improved and the deformation of the holder 214 is relatively small even when this holder 214 is formed of a resinous material. There is no gap between the holder 214 and the sleeve 12 at the nip part 16. The nip pressure is uniformized along the longitudinal direction of the holder. As a result, the fixing quality is uniform and excellent without both defective rotation or rupture of the sleeve 12 and defective conveyance of the sheet 10.

The resinous holder 214 is so constructed that the overall stiffness may be exalted by the supporting plates. It alleviates the stiffness that the resinous holder 214 itself is required. The holder 214, therefore, can be miniaturized in terms of the size, the diameter, or the wall thickness. And it is made possible to further narrow the air gap or the distance between the sleeve 12 and the electromagnet 213, strengthen the magnetic linkage between these two components, and improve the thermal efficiency of the sleeve 12. In addition, the decrease in diameter of the holder 214 results in lowering the cost and miniaturizing the fixing system 200 throughout the entire volume.

The supporting plates 241 are formed of a nonmagnetic material. The supporting plates 241 do not easily produce induction heating and have no possibility of lowering the thermal efficiency of the sleeve 12. The elongated parts 241*a* of the supporting plates 241 are disposed parallel to the magnetic flux. Thus, there is no possibility that the thermal efficiency of the sleeve 12 will be lowered.

Besides, it is unnecessary to use, as material for the holder 214, a resinous material which has an ample heat-resistance at the working temperature (fixing temperature) and is relatively high-priced. Namely, the holder 214 is inexpensive. Optionally, the stiffness of the holder material itself and the stiffness of the holder 214 may be strengthened by using such a fiber-reinforced thermoplastic resin as phenol resin (containing glass fibers) . In this case, it is preferable that the holder 14 formed of the fiber-reinforced thermosetting resin by extrusion molding is subjected to a hardening treatment at a temperature over the working temperature (fixing temperature) for accelerating the reaction of the unaltered cross-linked part.

The supporting plates 241 is in the shape of a simple plate The construction of the electromagnet 213 does not become complicated.

As clearly illustrated in FIG. 9, the holder 214 is so formed as to assume an unbroken periphery or an endless section as viewed in the plane perpendicular to the axis of the holder 214. The particular shape can contribute to improve the stiffness of the holder 214. The periphery of the electromagnet 213 is insulated in an endless manner by the holder 214. The electrical insulation between the coil 220 and the sleeve 12 is infallibly attained. It results in preventing the electric current passing through the coil 220 from a short-circuit via the sleeve 12.

Third Embodiment

Figure 10:
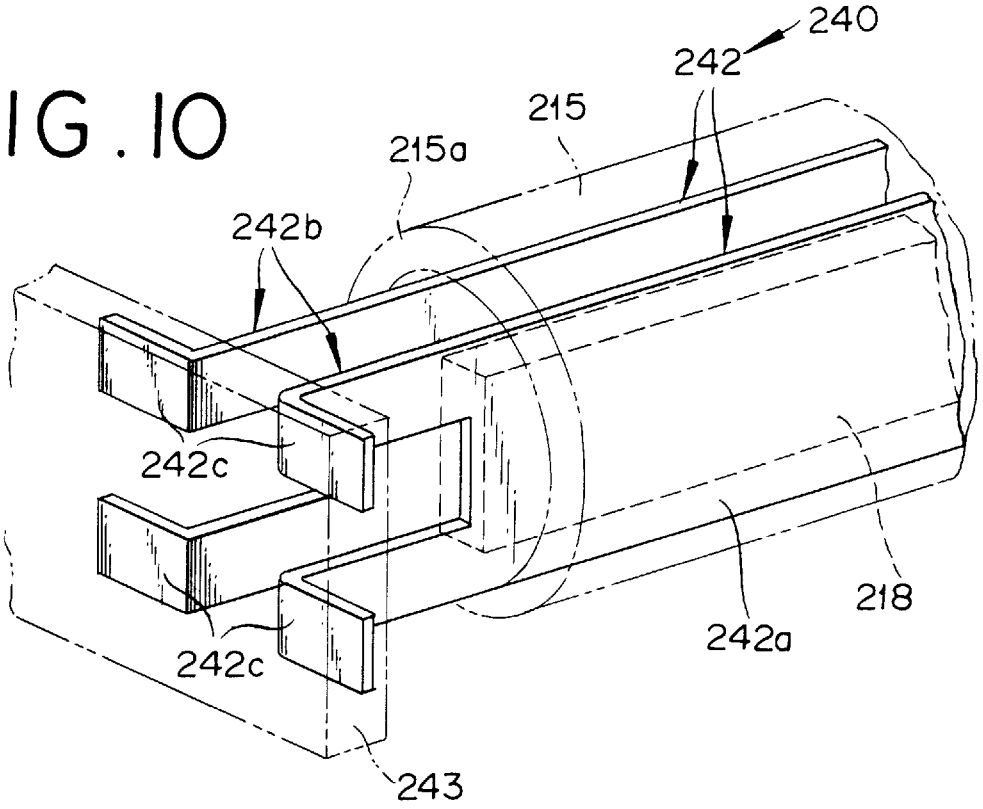
FIG. 10 is a perspective view illustrating the essential section of a supporting member in the third embodiment.

FIG. 10 is a perspective view illustrating the essential section of a supporting member 240 of the third embodiment. In this diagram, like members found in FIG. 9 are denoted by like reference numerals. They will be omitted from the following description. The third embodiment differs from the second embodiment in respect that it uses a modified construction for fixing a holder 215 and supporting plates 242.

In the second embodiment, the supporting plates 241 are kept in the holder 214 in such a manner that the terminal parts of the supporting plates 241 may not protrude from the terminal parts of the holder 214 and the opposite ends of the holder 214 are fixed to a rigid structure.

In contrast in the third embodiment, terminal parts 242*b* in the longitudinal direction of the supporting plates 242 are protruded outward from terminal parts 215*a* in the axial direction of the resinous holder 215. And the protruded terminal parts 242*b* in the longitudinal direction are fixed to a rigid structure 243 such as the frame of a fixing system. Flange parts 242*c* are formed as folded at the terminal parts 242*b* in the longitudinal direction of the supporting plates 242. The flange parts 242*c* is fixed to the rigid structure 243 by screwing, for example. It is allowable to have only the terminal parts 242*b* on one side of the supporting plates 242 fixed to the rigid structure 243. It is, however, advantageous to have the terminal parts 242*b* on both sides fixed to the rigid structure 243 in the sense of precluding the occurrence of a cantilever support. Incidentally, the vertically opposite ends of the elongated parts 242*a* of the supporting plates 242 collide against the inner periphery of the holder 215 in the same manner as in the second embodiment.

In the third embodiment, the pressure by the pressure roller 15 is directly supported by the supporting plates 242 fixed to the rigid structure 243. It results in strengthening the stiffness of the holder 215, attaining uniform and fully satisfactory fixation and precluding the sleeve 12 from defective rotation.

The holder 215 is supported by the supporting plates 242 accommodated inside. This holder 215 has no use for such stiffness as is needed for fixing the terminal parts of the holder to the rigid structure 243. In brief, the resinous holder 215 of the third embodiment has only to manifest mainly the function of nipping the sleeve 12 in cooperation with the pressure roller 15 and allowing the sleeve 12 to be smoothly slid. The holder 215 itself, therefore, may have a wall thickness smaller than in the second embodiment. The thermal efficiency of the sleeve 12 is further improved.

Fourth Embodiment

Figure 11:
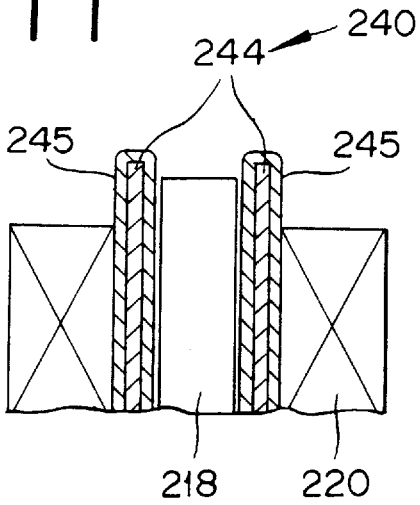
FIG. 11 is a cross section illustrating the essential section of a supporting member in the fourth embodiment.

FIG. 11 is a sectional view illustrating the essential section of a supporting member 240 in the fourth embodiment.

The supporting plates 244 of the fourth embodiment have at least a surface layer 245 with insulating properties. To be specific, the insulating surface layer 245 is formed by coating the surface of the supporting plate 244 with PI (polyimide), for example.

By forming insulating surface layers 245 on the supporting plates 244, the supporting plates 244 function as electrical insulating sections for electrically insulating a core 218 from induction coils 220 and ensure the electrical insulation between the two components 218 and 220. This fixing system, therefore, only rarely encounters a mechanical trouble and enjoys high reliability.

Fifth Embodiment

Figure 12A:
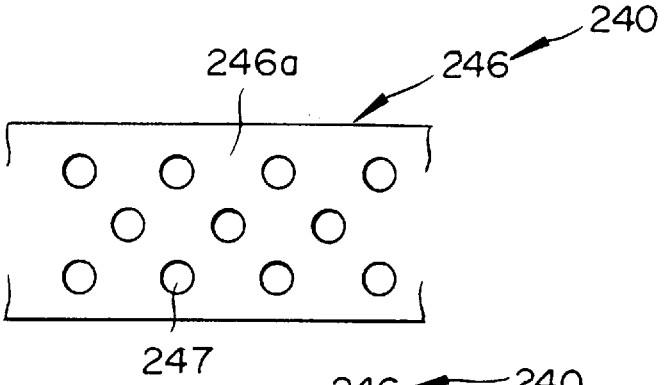
FIGS. 12A and 12B are sectional views illustrating the essential section of a supporting member in the fifth embodiment.
Figure 12B:
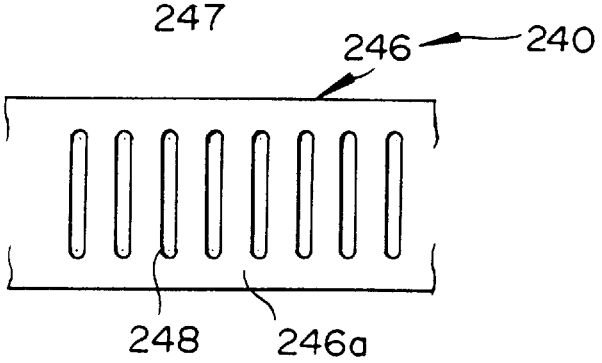

FIGS. 12A and 12B are sectional views illustrating the essential section of a supporting member 240 in the fifth embodiment.

The supporting plate 246 of the fifth embodiment has through hole section for inhibiting the generation of an induced current. Specifically, the through hole section are composed of openings 247 shown in FIG. 12A or slits 248 formed in an extended part 246*a* of the supporting plate 246.

By forming the through hole section in the supporting plate 246, the generation of an induced eddy is repressed. As a result, the supporting plate 246 generates induction heating with greater difficulty and the thermal efficiency of the sleeve 12 is prevented from lowering.

Figure 13:
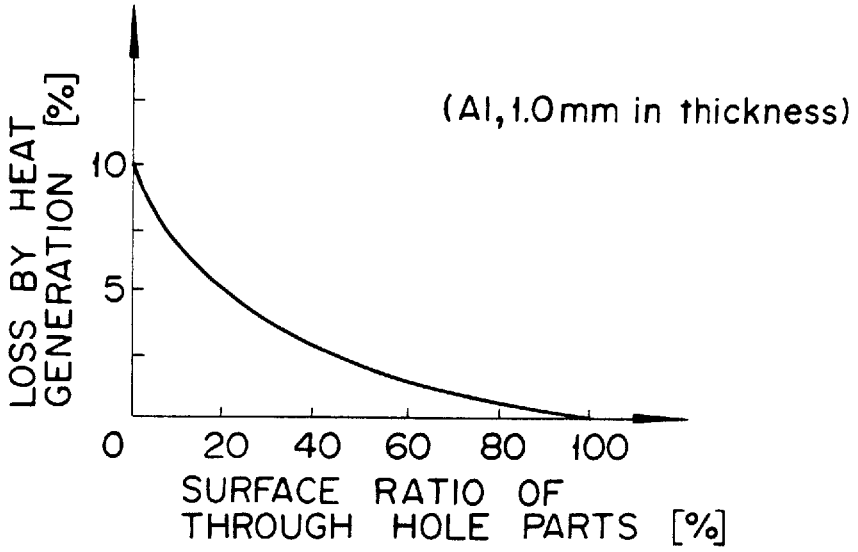
FIG. 13 a graph showing the relation between the area ratio of a through hole section and the loss of supplied electric power due to the heat generation of a supporting plate.

FIG. 13 is a graph showing the relation between the ratio of the open area to the through hole section and the loss of the supplied electric power due to the heat generation by the supporting plate. And the supporting plate is formed of aluminum in a wall thickness (t) of 1.0 mm. It is noted from this graph that the stiffness of the supporting plate 246 can be maintained and the loss of heat generation can be reduced by setting the ratio of the open area to the through hole section in proper ranges.

Sixth Embodiment

Figure 14A:
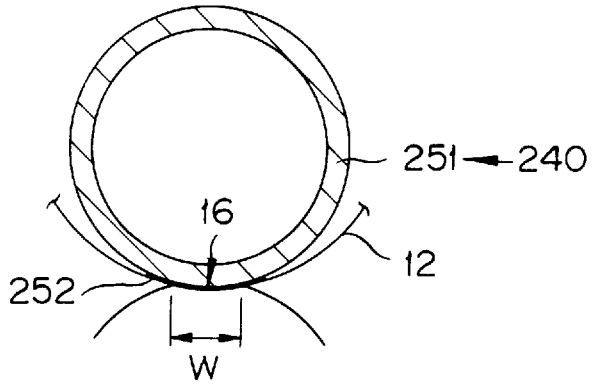
FIGS. 14A and 14B are sectional views illustrating the essential section of a supporting member in the sixth embodiment.
Figure 14B:
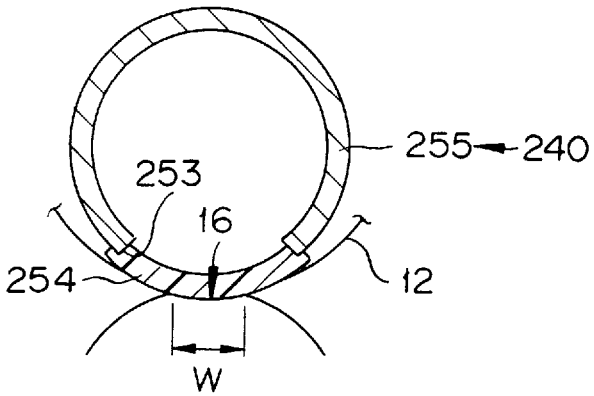

FIGS. 14A and 14B are sectional views illustrating the essential section of a supporting member 240 in the sixth embodiment. The electromagnet 13 is omitted from the diagrams.

The sixth and the seventh embodiments which will be described herein below, differ from the second embodiment through the fifth embodiment in respect that they change the material for the holder to strengthen the stiffness of the holder.

In the sixth embodiment, a supporting member 240 is constructed by forming at least part of a holder 251 with a material of high stiffness other than resin. Specifically, the holder 251 having a cylindrical shape as illustrated in FIG. 14A, is formed of a ceramic material or glass, for example. The use of a metallic substance as the material of high stiffness is not advantageous, because the metallic holder has increased loss of heat generation in response to the magnetic flux generated by the electromagnet.

The holder 251 comprises a outer skin 252 with high sliding properties to the sleeve 12. The outer skin 252 comes in contact with the sleeve 12 which generates heat by electromagnetic induction. The outer skin 252 is preferably formed of a material having a higher heat resistance temperature than the holder 251 for improving high-temperature resistance. Exactly, the outer skin 252 with high sliding properties is formed by giving a mirror finish to the relevant area of the holder 251 or covering the area with PTFE. The outer skin 252 is preferably formed in a length at least greater than the nip width W which is formed between the sleeve 12 and the pressure roller 15. In this construction, the sleeve 12 securely comes in contact with the outer skin 252.

The holder 255 does not need to be limited to a simple cylindrical shape. As illustrated in FIG. 14B, the holder 255 may be formed in a cylindrical shape with a notch formed by continuously extending, in the axial direction, openings 253 facing toward the area contiguous to the sleeve 12 as viewed in plane perpendicular to the axis. A fitting section 254 having an arcuate cross section is fitted into the openings 253. The fitting section 254 is formed of PI, PEEK, or the like with high sliding properties to the sleeve 12. A material for the fitting section 254 also has a higher heat resistance temperature than the holder 255 for improvement of the high-temperature resistance. And the length of fitting section 254 is to be greater than the nip width W.

In the sixth embodiment with the supporting member 240, the holders 251, 255 are formed of a material with high stiffness for improving rigidity. Thus, no gap is formed between the outer skin 252 and the fitting section 254. The uniform and excellent fixing quality is obtained and the defective rotation of the sleeve 12 or other similar trouble is eliminated even when the pressure by the pressure roller 15 is supported by the holders 251, 255.

The holders 251, 255 comprise the outer skin 252 and the fitting section 254 with high sliding properties The sliding resistance between these holders 251, 255 and the reverse face of the sleeve 12 is small and the load on the rotation of the sleeve 12 is extremely small. As a result, the sleeve 12 is smoothly rotated and the sheet 10 is securely fed without difficulty.

Seventh Embodiment

Figure 15:
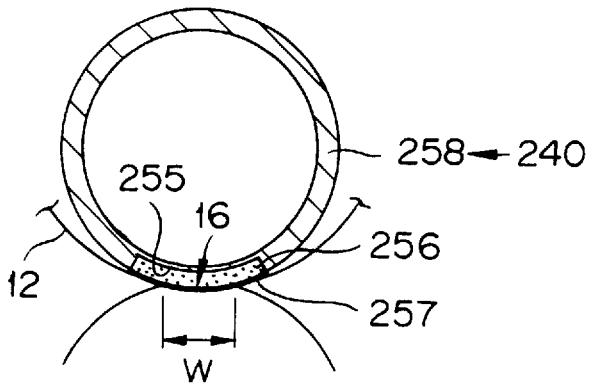
FIG. 15 is a sectional view illustrating the essential section of a supporting member in the seventh embodiment.

FIG. 15 is a sectional view illustrating the essential section of a supporting member 240 in the seventh embodiment. The electromagnet 13 is omitted from the diagram.

In the seventh embodiment, a supporting member 240 is defined by forming at least part of a holder 258 with a material of high stiffness other than resin. Specifically, the holder 258 is made of a ceramic material or glass in a cylindrical shape having groove 255 which is formed along the axial direction and opposed to the area contiguous to the sleeve 12 as viewed in the plane perpendicular to the axis.

The holder 258 is provided with a fitting section 256 with low thermal conductivity in the area contiguous to the sleeve 12. The fitting section 256 comes in contact with the sleeve 12 which rises in temperature by electromagnetic induction heating. The fitting section 256 is preferably formed of a material with higher heat resistance temperature than the holder 258 for improving high-temperature resistance. To be specific, the fitting section 256 is formed as a silicone rubber or sponge rubber with an arcuate cross section put into the groove 255. The fitting section 256 is preferably formed in a length greater than the nip width W along the direction of conveyance of the sheet 10. In this construction, the sleeve 12 securely comes in contact with the fitting section 256.

The surface of the fitting section 256 is preferably provided with an outer skin 257 with high sliding properties to the sleeve 12.

In the seventh embodiment with the supporting members 240, the holder 258 is formed of a material with high stiffness for improving rigidity. Therefore, no gap is generated between the fitting section 256 (or the outer skin 257) and the sleeve 12. The fixing quality is uniform and satisfactory. And defective rotation of the sleeve 12 or other similar trouble is eliminated even when the pressure by the pressure roller 15 is supported by the holder 258.

The holder 258 comprises the fitting section 256 with low thermal conductivity. It is made possible to prevent the heat of the sleeve 12 generated with electromagnetic induction from transferring toward the holder 258 and minimize the loss of thermal energy. As a result, the fixing system utilizing the present embodiment enjoys high thermal efficiency and accomplishes energy-saving.

Eighth Embodiment

Figure 16:
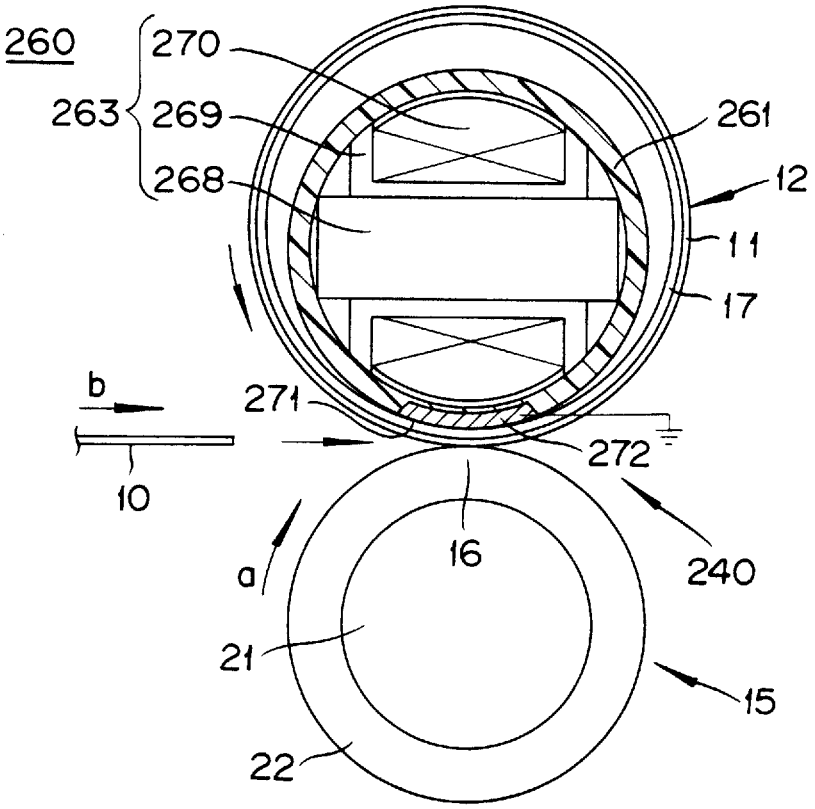
FIG. 16 is a sectional view schematically illustrating a fixing system according to the eighth embodiment.

FIG. 16 is a sectional view illustrating a fixing system 260 according to the eighth embodiment. In this diagram, like members found in FIG. 9 are denoted by like reference numerals. These members will be omitted from the following description. The eighth embodiment differs from the second embodiment in respect that a holder 261 is formed of a resinous material and the stiffness of the holder 261 is strengthened without using the supporting plates 241.

In the fixing system of the eighth embodiment, an electromagnet 263 is further provided with a bobbin 269 having a central through hole. A coil 270 is formed by winding a copper wire a plurality of turns around this bobbin 269. A core 268 is inserted into the through hole of the bobbin 269 in such a manner as to intersect the copper wire of the coil 270 perpendicularly. A holder 261 formed separately of the bobbin 269 accommodates and maintains the electromagnet 263 so that the core 268 may be parallel to the direction of conveyance of the sheet and may not project outside. The bobbin 269 rises in temperature by the heat of the induction coil 270 and the heat transfer from surrounding areas. The bobbin 269 requires to have high-temperature resistance enough to withstand at least the fixing temperature or the surface temperature of the sleeve 12. For that reason, the bobbin 269 is formed of a ceramic material or an engineering plastic material with high-temperature resistance and electrical insulating properties.

The electromagnet 263 is provided with the bobbin 269 wound with a copper wire. The winding of the copper wire is facilitated and reliably controlled. The bobbin 269 functions as an insulating section for electrically insulating the core 268 from the induction coil 270 and ensuring the electrical insulation between the two components 268 and 270. Thus, the fixing system develops a mechanical trouble only rarely and enjoys high reliability.

In the eighth embodiment, the holder 261 is in the shape of a cylinder formed of the same resinous material as shown in the second embodiment. The holder 261 comprises a groove 271 which is opposed to the area contiguous to the sleeve 12 as viewed in the plane perpendicular to the axis, and extends along the axial direction.

The supporting member 240 strengthens stiffness of the resinous holder 261 by supporting the pressure from the pressure roller 15. The supporting member 240 is composed of a fitting section 272 formed of a magnetic metal and is disposed in the area of the resinous holder 261 which is contiguous to the sleeve 12. The term "magnetic metal" refers to a metal which generally has a relative permeability of not less than about 100, wherein the magnetic flux density and the heat generation are in direct proportion to the relative permeability. The fitting section 272 specifically is made of SUS430, cobalt, nickel, iron, or nickel-iron alloy (permalloy). The fitting section 272 is formed in an arcuate cross section and is put into the groove 271 of holder 261. Further, the fitting section 272 is electrically grounded.

Figure 17:
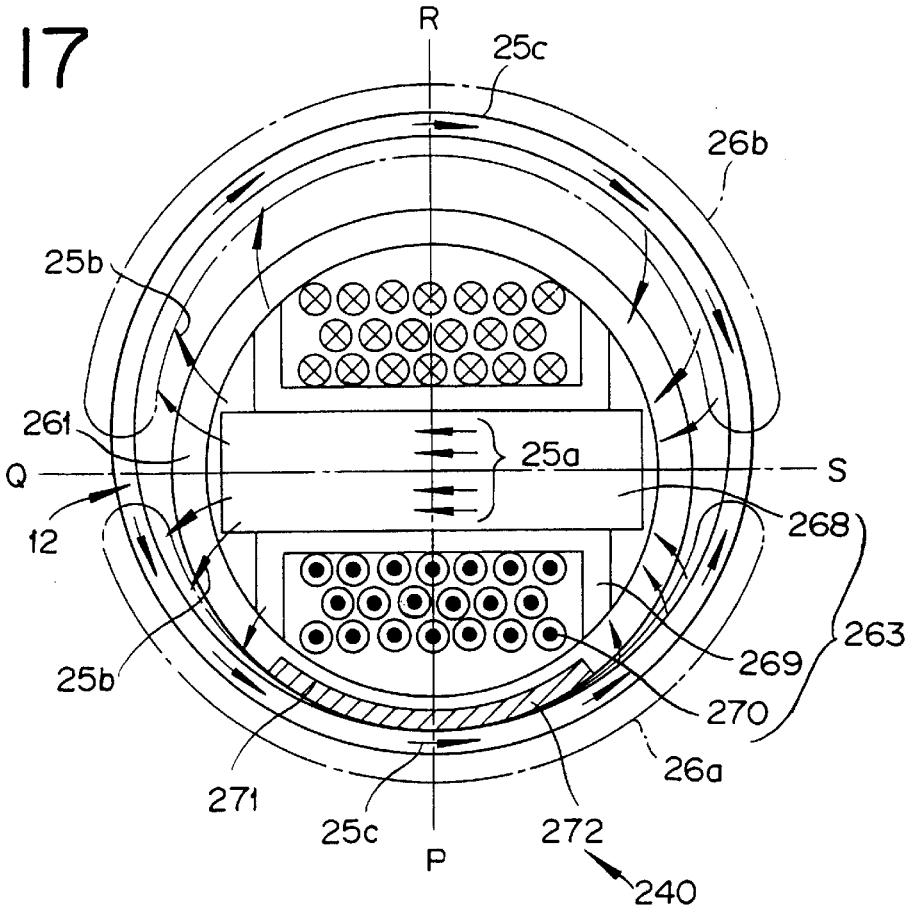
FIG. 17 is a diagram illustrating the heating principle of a sleeve in a fixing system in the eighth embodiment.

FIG. 17 is a diagram showing the heating principle of the sleeve 12 in the fixing system of the eighth embodiment. The heating principle is the same as that which has been described with reference to FIG. 2 and, therefore, will be omitted from the following description. Besides, the core 268 with the coil 270 formed around the periphery is disposed parallel to the direction of conveyance of the sheet 10. Consequently, one of the heat generating areas of the fixing sleeve 12 overlaps with the nip part 16. Namely, the electromagnet 263 is constructed so that the heat generation may be approximately maximized in the fitting section 272.

In the eighth embodiment with the supporting members 240, the fitting section 272 made of a magnetic metal is disposed in the sliding face between the holder 261 and the sleeve 12 for reinforcing the overall stiffness of the resinous holder 261. Thus, no gap is generated between the fitting section 272 and the sleeve 12. The fixing quality is uniform and satisfactory. And the ineffective rotation of the sleeve 12 or other similar trouble is eliminated even when the pressure by the pressure roller 15 is supported by the holder 261 itself.

In this case, the fitting section 272 rises in temperature in response to the magnetic flux generated in the electromagnet 263. The thermal energy of the fitting section 272 is, however, transferred to the sleeve 12. From the overall point of view, the fixing system enjoys high thermal efficiency and the energy-saving.

The fitting section 272 is grounded electrically. The electric current passing through the coil 270 is infallibly prevented from short-circuiting via the sleeve 12.

Figure 18:
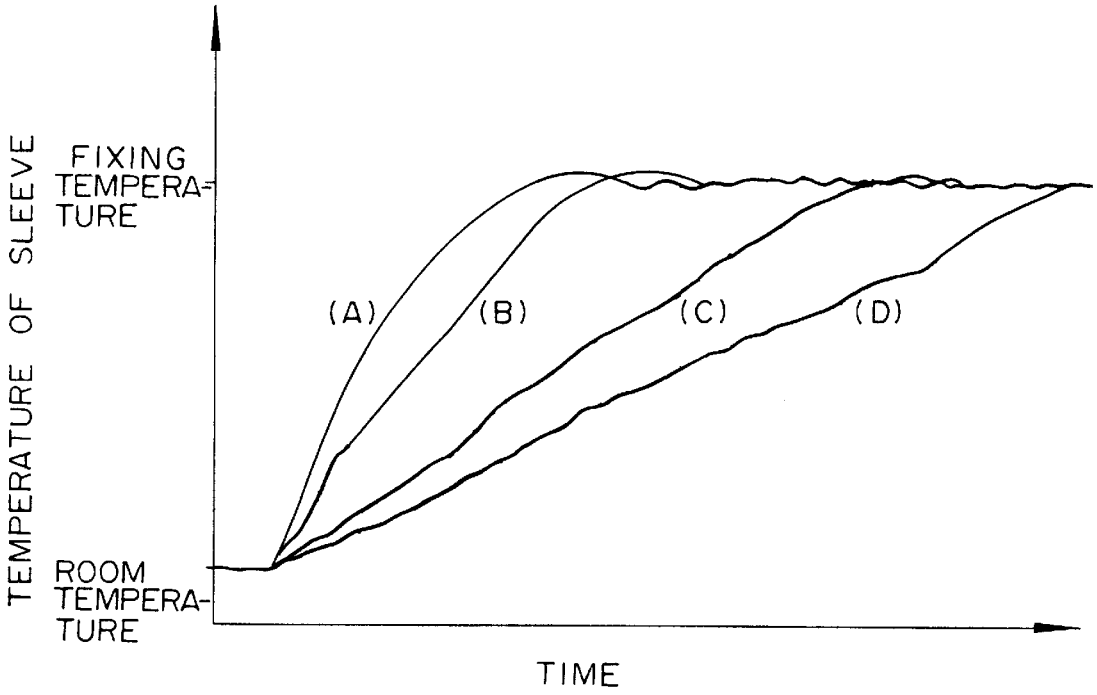
FIG. 18 is a graph showing the temperature rise characteristics in a fixing system of the eighth embodiment together with an example for comparison.

FIG. 18 is a graph comparing the temperature rise characteristics of the fixing system of the eighth embodiment with those of comparative examples. Specially, the curve (A) represents the temperature rise characteristics of Comparative Example 1 using a resinous holder without a fitting section 272, the curve (B) the temperature rise characteristics of the eighth embodiment, the curve (C) the temperature rise characteristics of Comparative Example 2 having the electromagnet of the eighth embodiment disposed in such a manner that the longitudinal direction of the cross section of the core perpendicularly intersects the direction of conveyance of the sheet, and the curve (D) the temperature rise characteristics of Comparative Example 3 having a fitting section made of a nonmagnetic metal in the place of the fitting section 272 of the eighth embodiment.

Concerning the fixing system, the time referred to as "quick fixation" is generally preferred to be within 10 seconds of starting the power supply in consideration of the efficiency of operation. The fixing system, therefore, is required to heat the sleeve up to the predetermined range of fixing temperature (150° C.–200° C., for example) within the allowable time limit of 10 seconds.

In Comparative Example 1 [FIG. (A)], the sleeve could be heated up to the fixing temperature within the allowable time limit. However, a stable fixing quality could not be obtained because no supporting member 240 was provided and the holder was deficient in stiffness.

In Comparative Example 2 [FIG. (C)], the holder had necessary stiffness because of the provision of the fitting section 272 made of a magnetic metal. Nonetheless, the rate of temperature rise was low and the sleeve did not heat up to the predetermined fixing temperature even after the elapse of the allowable time limit, because the heat generation was not maximized in the fitting section 272.

In Comparative Example 3 [FIG. (D)], the holder had necessary stiffness because of the provision of the fitting section made of a nonmagnetic metal. However, the rate of temperature rise was low and the sleeve did not heat up to the predetermined fixing temperature even after the elapse of the allowable time limit, because the heat of sleeve was transferred to the fitting section.

In contrast, in the eighth embodiment, the holder had necessary stiffness and the rate of temperature rise was high and the sleeve 12 heated up to the fixing temperature within the allowable time limit. Because the fitting section 272 made of a magnetic metal is provided and the fitting section 272 coincided with the portion of the maximum heat generation and the heat of the fitting section 272 in consequence of the electromagnetic induction was transferred to the sleeve 12.

Ninth Embodiment

Figure 19:
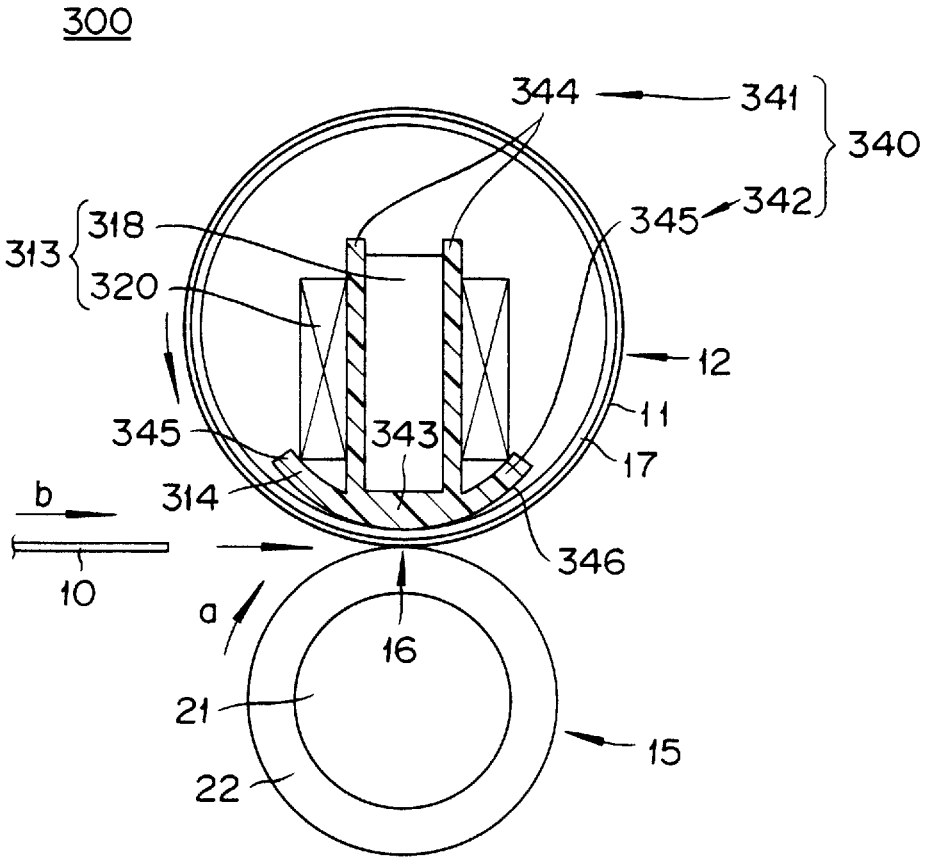
FIG. 19 is a sectional view schematically illustrating a fixing system according to the ninth embodiment.

FIG. 19 is a sectional view schematically illustrating a fixing system 300 according to the ninth embodiment. In the diagram, like members found in FIG. 1 are denoted by like reference numerals. These members will be omitted from the following description.

The fixing system 300 of the ninth embodiment, similarly to the equivalents of the first and the second embodiment, utilizes induction heating and fulfills the following two of the three formulas.

$$S1+S2 \geqq 0.3 \times S3 \quad (1)$$

$$0.2 \leqq S2/(S1+S2) \leqq 0.8 \quad (2)$$

The ninth embodiment is not limited by the formula (3) applied to a holder having a substantially cylindrical shape, because the holder of the ninth embodiment is not in a cylindrical shape. The tenth embodiment which will be described herein below fulfills the Formulas (1) and (2).

The fixing system 300 of the ninth embodiment is particularly provided with insulating means 340 composed of a first insulating piece 341 and a second insulating piece 342 as one. The first insulating piece 341 insulates a core 318 with a coil 320 in an electromagnet 313. The second insulating piece 342 insulates the electromagnet 313 with the sleeve 12. The fixing system 300 of the ninth embodiment moves the sleeve 12 which rises in temperature in consequence of induction heating as nipped between the holder 314 and the pressure roller 15. Accordingly, the insulating means 340 maintains the electromagnet 313 and is disposed stationarily inside the sleeve 12. And the insulating means 340 fulfills concurrently the function of the holder 314 with insulation properties against which the pressure roller 15 is pressed through the sleeve 12.

To be more specific, the insulating means 340 comprises a base 343 having an arcuate cross section, a pair of plates 344 formed on the base 343 across a predetermined distance, and an extension 345 extending left to right in the diagram along the circumferential direction. The coil 320 is formed by winding a copper wire a plurality of turns around the pair of plates 344. The core 318 is inserted into the groove formed between the plates 344 in such a manner as to intersect perpendicularly the copper wire of the coil 320.

The core 318 is formed of a ferrite core or a laminate core, for example. The core 318 has a simple shape of a letter I. Thus, the core 318 is produced at a low cost and inserted between the plates 344 with ease.

The copper wire composed of the coil 320 is preferably a simple or litz copper wire with a fused layer and an insulating layer on the surface.

The plate 344 of the insulating means 340 has a length amply greater than the length of the core 318 in the longitudinal direction of the cross section of the core 318, and the plate 344 functions as the first insulating piece 341. The extension 345 of the insulating means 340 has a length enough to cover the lower end of the coil in the diagram, and the extension 345 functions as the second insulating piece 342. The plate 344 (first insulating piece 341) and the extension 345 (second insulating piece) are formed in conjunction with the base 343 as one. The pressure roller 15 is pressed against the base 343 of the insulating means 340 through the sleeve 12. The insulating means 340 rises in temperature by the heat of the induction coil 320 and the heat transfer from the surrounding areas. The insulating means 340 requires to possess high-temperature resistance over at least the fixing temperature or the surface temperature of the sleeve 12 as well as the insulating properties. The material for the insulating means 340 has no particular restriction except the requirement of the insulating properties and the high-temperature resistance. The insulating means 340 is preferably formed of a resinous material with high-temperature resistance and insulating properties in consideration of the fact that a resinous material can be easily formed integrally in a stated shape and can be formed with high accuracy. Specifically, the insulating means 340 is preferably formed of such a thermosetting resin as phenol resin or a fiber-reinforced thermosetting resin.

In the insulating means 340 which concurrently functions as the holder 314, the base 343 is positioned in the area contiguous to the sleeve 12 and provided with an outer skin 346 having high sliding properties to the sleeve 12. Specifically, the outer skin 346 is formed by giving a mirror finish to the base 343 of the insulating means 340 or by covering the base 343 with PTFE. The outer skin 346 is preferably formed in a length at least greater than the nip width between the sleeve 12 and the pressure roller 15. In this construction, the sleeve 12 may come in contact with the outer skin 346 without fail.

In the ninth embodiment with the insulating means 340, the plate 344 functions as the first insulating piece 341 for insulating the core 318 from the coil 320, and the extension 345 functions as the second insulating piece for insulating the electromagnet 313 from the sleeve 12. Owing to this construction, the electrical insulation surely precludes a short-circuit between the core 318 and the coil 320 and between the electromagnet 313 and the sleeve 12. Consequently, the fixing system develops a mechanical trouble rarely and enjoys high reliability. Though the extension 345 of the insulating means 340 does not wholly cover the electromagnet 313, exposed area of the electromagnet 313 incurs absolutely no trouble. Because spacing for insulation is secured between the electromagnet 313 and the inner face of the sleeve 12. However, the exposed area may be provided with an insulating film of PI, fluororesin or the like having a thickness in the approximate range of 30 $\mu$m–100 $\mu$m when the distance of insulation is not sufficient.

The insulating means 340 is formed by integrating the first insulating piece 341 and the second insulating piece 342 as one. Thus, a number of components of the insulating means 340 is decreased and the manufacturing cost is reduced as compared with insulating means which are assembled with separate components.

The holder 314 is provided with the outer skin 346 with high sliding properties. The sliding resistance between the holder 314 and the rear face of the sleeve 12 is small and the load on the rotation of the sleeve 12 is extremely small. As a result, the sleeve 12 is rotated without fail and the sheet 10 is smoothly fed for certain.

Tenth Embodiment

Figure 20:
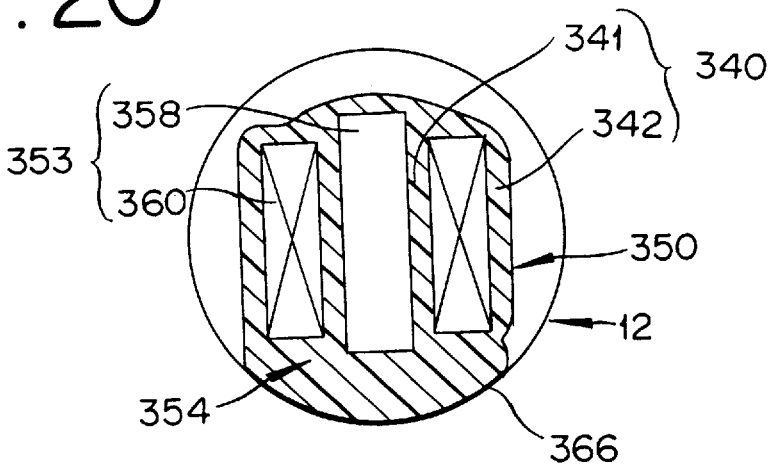
FIG. 20 is sectional view illustrating a heating device in a fixing system according to the tenth embodiment.

FIG. 20 is a sectional view illustrating a heating device of the fixing system according to the tenth embodiment.

In the tenth embodiment, the insulating means 340 consists of a component 350 made of a resinous material with high-temperature resistance and insulating properties. The component 350 is preferably formed by integrating the core 358 with the coil 360. Because the integral molding of the core 358 and the coil 360 may fulfill concurrently the function as the holder 354. The resinous material for component 350 is preferably PI, PEEK, or the like. The resinous material has high sliding properties to the sleeve 12. An outer skin 366 with high sliding properties is constructed by molding the resin in the predetermined shape and giving a mirror finish to the portion of the resultant resinous mold that comes in contact with the sleeve 12.

In the tenth embodiment, the resinous piece which has flowed into the space between the core 358 and the coil 360 functions as the first insulating piece 341 to insulate the core 358 from the coil 360. The resinous piece which has surrounded the overall outer periphery of the core 358 and the coil 360 functions as the second insulating piece 342 to insulate the electromagnet 353 from the sleeve 12. And the resinous piece which has flowed into the space between the adjacent plies of the winding of the coil 360 insulates the adjacent plies of the winding. Owing to this construction, the electrical insulation is secured between the core 358 and the coil 360, between the electromagnet 353 and the sleeve 12, and between the adjacent plies of the winding. Namely, the occurrence of a short-circuit is precluded. Consequently, the fixing system develops a mechanical trouble only rarely and enjoys high reliability.

The insulating means 340 is the integral component 350 formed by the monolithic molding with a resinous material, which functions as the first and second insulating pieces 341 and 342. As a result, the manufacture is simply done at a low cost as compared with the manufacture with assemblies as the insulating pieces.

The electromagnet 353 is wholly molded with a resinous material. It results in improving mechanical strength of itself and increasing the degree of freedom of selection of the holder shape.

Eleventh Embodiment

Figure 21:
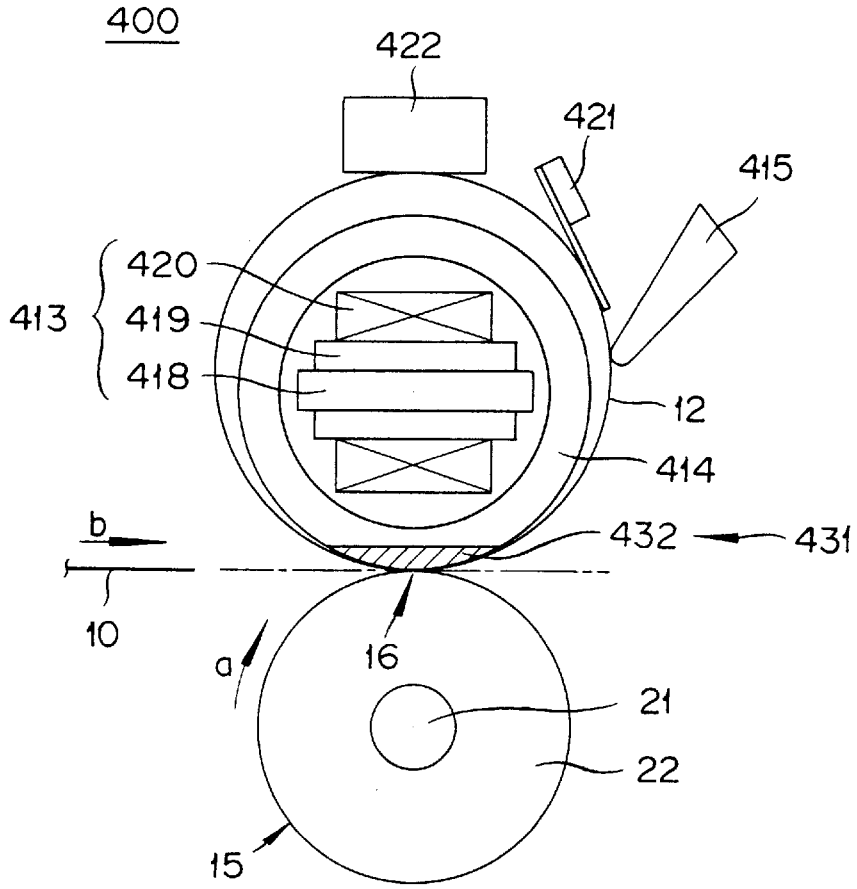
FIG. 21 is a sectional view perpendicular to an axis and schematically illustrating a fixing system according to the 11th embodiment.
Figure 22:
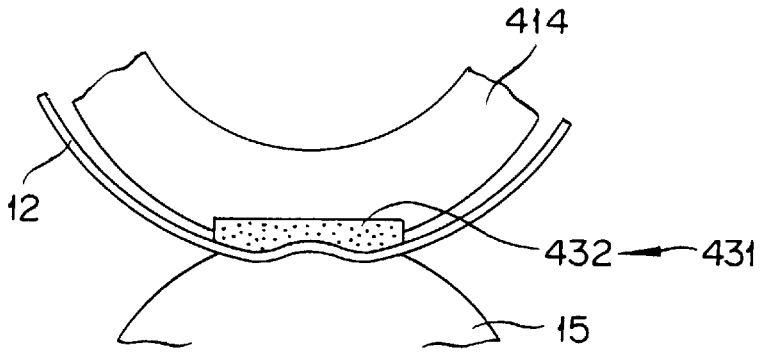
FIG. 22 is an enlarged diagram of the essential section of a fixing system of the eleventh embodiment wherein the contact section at which a holder comes in contact with a sleeve, is made of a foamed elastic material with high-temperature resistance.

FIG. 21 is an axially perpendicular sectional view schematically illustrating a fixing system 400 according to the eleventh embodiment. FIG. 22 is an enlarged diagram illustrating the essential section of the fixing system. In these diagrams, like members found in FIG. 1 are denoted by like reference numerals. These members will be omitted from the following description.

The fixing system 400 of the eleventh embodiment utilizes induction heating, similarly to those of the first, second, and ninth embodiments. It is constructed to fulfill the following two of the three formulas.

$$S1+S2 \geqq 0.3 \times S3 \quad (1)$$

$$0.2 \leqq S2/(S1+S2) \leqq 0.8 \quad (2)$$

The eleventh embodiment is relieved of the Formula (3) applied to a fixing system using a holder with a substantially cylindrical shape, because the two components, i.e. the holder and the sleeve, have a special construction. The twelfth and thirteenth embodiments which will be described herein below are also constructed to fulfill the Formulas (1) and (2).

The present embodiment, however, preferably fulfills the following part of the Formula (3).

$$Dmax \leqq 5 \text{ mm}$$

wherein Dmax stands for the maximum distance formed between the outer periphery of the holder and the internal surface of the sleeve.

In the fixing system 400 of the eleventh embodiment, the sheet 10 is passed through the nip part 16 and the leading end of the sheet 10 is separated from the sleeve 12 by a separation claw 415 which comes in contact with the surface of the metallic sleeve 12. The separation claw 415 is formed of an engineering plastic material with high-temperature resistance and insulating properties as well as a holder 414 and a bobbin 419. A temperature sensor 421 is mounted above the sleeve 12 to detect the temperature of the sleeve 12. The temperature sensor 421 is pressed against the surface of the sleeve 12 as opposed to the coil 420 across the sleeve 12. A thermostat is disposed above the sleeve 12 as a safety mechanism against abnormal temperature rise. The thermostat 422 keeps in contact with the surface of the sleeve 12. When the temperature of the sleeve 12 reaches a preset level, the thermostat 422 releases the electric contact to stop the power supply to an induction coil 420 and prevent the temperature of the sleeve from rising beyond the preset level.

The holder 414 of the eleventh embodiment is particularly provided, at the position of the nip part 16, a contact section 431 which comes in contact with the sleeve 12 along the longitudinal direction (axial direction) of the holder 414. The contact section 431 is formed of a component 432 containing air bubbles or an air layer with high-temperature resistance.

The holder is generally made of a heat-resistant resin or glass which is not deformed under the pressure and high temperature for fixation. The resinous material has low thermal conductivity as compared with a metallic material. A considerable quantity of heat is, however, transferred from the sleeve 12 to the holder because of direct contact between the sleeve 12 and the holder. Thus, the heat transferred from the sleeve increases and the warming up time is prolonged in accordance as the thermal capacity of the holder increases. Besides, it is difficult to transfer desired quantity of heat to the sheet when a temperature of the holder is low. Thus, the electric power supplied to the holder must be greatly increased during the initial stage of printing. The heat transferred to the holder must be decreased to the fullest possible extent for minimizing the maximum power for fixing the toner on the sheet From this particular point of view, the holder 414 of the eleventh embodiment is provided with the contact section 431 composed of the component 432 containing air bubbles or an air layer with high-temperature resistance. The contact section 431 shows outstanding thermal insulating properties as compared with a solid resinous material, and reduces the heat transfer to the holder 414. The electromagnet 413 is utilized for rising the sleeve 12 in temperature based on the induction heating. In other words, the fixing system of the present embodiment has absolutely no need of contacting the sleeve 12 with an electrode unlike a fixing system having a sleeve with a layer of a resistance heating element. Owing to this construction, the present embodiment has highly thermal insulating properties. The holder 414 is fixed and the sleeve 12 is rotated while the inner face of the sleeve 12 is in contact with the holder 414. The construction prevents the heat from easily transferring to the entire holder 414 and the thermal efficiency from lowering as compared with the construction in which the holder is rotated.

The component 432 composing the contact section 431 is inserted into a groove formed in the longitudinal direction on the surface of the holder 414 as illustrated in FIG. 22 and is secured with an adhesive agent and the like with high-temperature resistance. Any method may be applied on the condition that the component 432 is securely mounted. The component 432 preferably having a comparatively elongated shape with a length equaling the size of the holder 414 along the longitudinal direction. Optionally, a plurality of such components 432 with a relatively small length may be disposed along the longitudinal direction of the holder on the condition that they are capable of pressing the sleeve 12 without fail.

The component 432 composing the contact section 431 is suitably a foamed elastic material with high-temperature resistance. Specifically, the component 432 is made of a foam sponge rubber or foam silicone rubber. The surface hardness of the contact section 431 is preferably lower than the surface hardness of the pressure roller 15. The sleeve 12 may be bent along the curvature radius of the outer periphery of the pressure roller 15 when the surface hardness of the contact section 431 is appropriately set as by suitably selecting the material. Consequently, the sheet 10 with the fixed toner can be easily separated from the sleeve 12 and the wide nip part can be securely obtained. Therefore, the contact section 431 decreases the thermal diffusion by the effect of thermal insulation, the heat transfer to the sheet 10 increases and the fixing temperature can be set at a low level.

Now, the operation of the fixing system according to the eleventh embodiment will be described below.

First, a high-frequency current is supplied to the coil 420. The sleeve 12 is induced to generate a high-frequency current to heat up. Because the sleeve 12 is made of a magnetic metal. The sleeve 12 rises in temperature at a high rate, because the method of induction heating shows a high thermal efficiency and the sleeve 12 formed in a small wall thickness has a low thermal capacity. The preheating time, therefore, can be shortened and the power consumption can be reduced.

Subsequently, the sleeve 12 is nipped between the pressure roller 15 and the holder 414 while rotates by a driving force generated from the contact with the pressure roller together with the rotation of the pressure roller 15. The sheet 10 with an unfixed toner image which has been transferred on the surface is forwarded toward the nip part 16 between the sleeve 12 and the pressure roller 15. Arid the sheet 10 is conveyed through the nip part 16 under the heat of the hot sleeve 12 and the pressure of the pressure roller 15. As a result, the toner is fixed on the sheet 10.

Here, the heat of the hot sleeve 12 transfers to not only the sheet 10 but also the holder 414 which is held in contact with the inner face of the sleeve 12. However, the contact section 431 of the holder 414 is formed of the component 432 having air bubbles or an air layer with high-temperature resistance as means to block the transfer of heat to the holder 414. The contact section 431 shows an outstanding thermal insulating effect as compared with a solid resinous material. In short, the contact section 431 minimizes the heat transfer to the holder 414.

As described above, the eleventh embodiment is capable of not only heating the sleeve 12 efficiently but also utilizing the greater part of the generated heat for fixing the toner. Thus, it can exalt greatly the actual efficiency of heat generation and accomplish the energy-saving.

Figure 23:
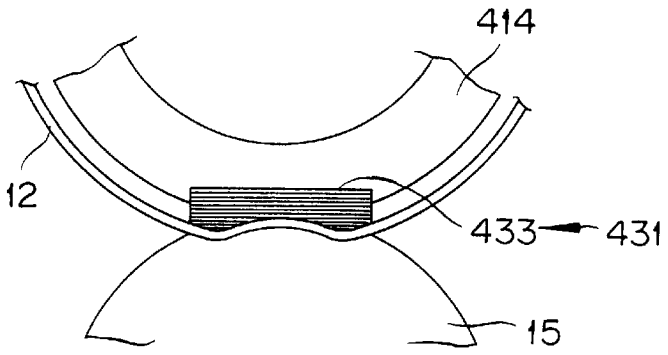
FIG. 23 is an enlarged diagram of the essential section of a fixing system wherein the contact section is made of a felt with high-temperature resistance.

The component 432 composing the contact section 431 does not need to be limited to what has been described above. A heat-resisting felt 433 as illustrated in FIG. 23, for example, may be used instead. Specifically, the component 432 composes a felt containing polyamide fibers or glass fibers, etc.

Figure 24:
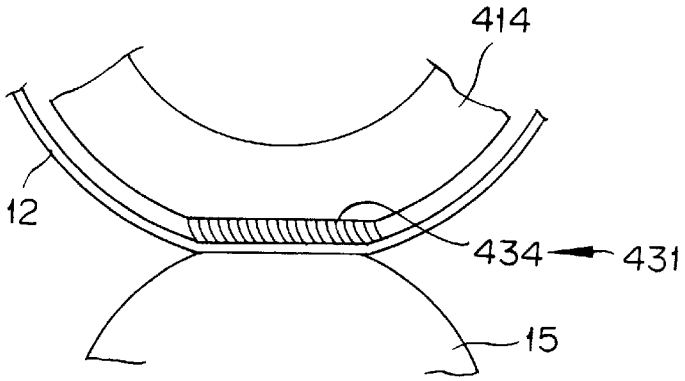
FIG. 24 is an enlarged diagram of the essential section of a fixing system wherein the contact section is made of a brush with high-temperature resistance.
Figure 25:
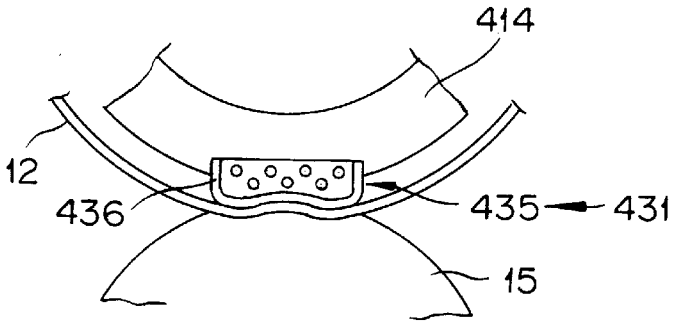
FIG. 25 is an enlarged diagram of the essential section of a fixing system wherein the contact section is made of a porous material with high-temperature resistance.

A heat-resisting brush 434 as illustrated in FIG. 24 or a heat-resisting porous substance 435 formed of porous ceramic as illustrated in FIG. 25 may be used as the component 432.

Optionally, a outer skin 436 with high sliding properties and high-temperature resistance may be further formed on the surface of the contact section 431 as illustrated in FIG. 25. The outer skin 436 is suitably made of such material as, PTFE, PFA, or PI. The outer skin 436 lowers the friction coefficient between the sleeve 12 and the contact section 431. The sleeve 21 rotates stably and smoothly which keeping in contact with the outer skin 436 or the contact section 431. And the deterioration of the sleeve 12 due to friction is reduced and the service life is prolonged.

Optionally, the contact section 431 may be impregnated with a lubricant and possess thermal insulating properties. To be specific, the contact section 431 is formed of a felt or an elastic material which is impregnated with such a lubricant as grease or oil. The contact section 431 fulfills an additional function as supply the lubricant for the smooth rotation of the sleeve 12. The construction can reliably reduce the transfer of heat to the holder 141 and stably rotate the sleeve 12 in contact with the holder 414.

Twelfth Embodiment

Figure 26:
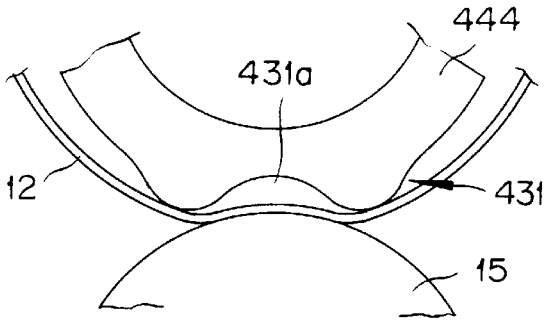
FIG. 26 is an enlarged diagram of the essential section of a fixing system according to the twelfth embodiment.

FIG. 26 is an enlarged diagram illustrating the essential section of a fixing system according to the twelfth embodiment. In this diagram, like members found in the eleventh embodiment are denoted by like reference numerals. These members will be omitted from the following description.

In this twelfth embodiment, the contact section 431 of a holder 444 is in the shape of a curved shape and has a recess 431*a* which is inwardly depressed. It differs from the contact section of the eleventh embodiment which is a separate component and is fixed to the surface of the holder 414.

In the twelfth embodiment, the transfer of heat to the holder 444 is reduced by forming the holder 444 in the shape of a curved face and generating a space between the holder 444 and the sleeve 12 even when the pressure roller 15 presses the sleeve 12 in the direction of the holder 444. The recess 431a may be coated with a lubricant 445 (refer to FIG. 27) such as grease or oil for reducing the deterioration of the sleeve 12 by abrasion and stabilizing the rotation of the sleeve 12.

According to the twelfth embodiment, the contact face between the sleeve 12 and the holder 444 is limited to the opposite sides of the recess 431*a*. The transfer of heat to the holder 444 can be decreased and the actual thermal efficiency can be improved even when the nip width is enlarged. The contact face of the holder 444 with the sleeve 12 composes a curved surface. The sleeve with the metallic layer does not need to be forcibly bend. Thus, stress fatigue of the sleeve 12 is reduced and the service life of the sleeve is lengthened. In addition, the embodiment requires no addition of any separate component and can lower the cost.

Figure 27:
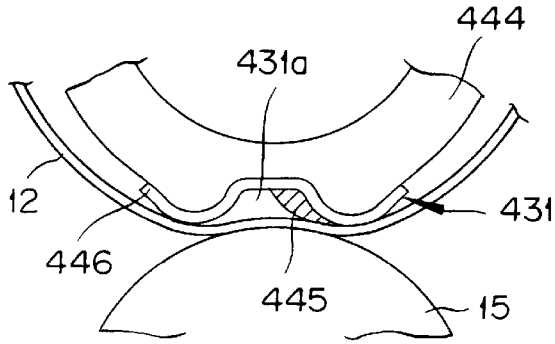
FIG. 27 is an enlarged diagram of the essential section of a fixing system wherein an outer skin with high sliding properties and high-temperature resistance is formed on the surface of the contact section.

An outer skin 446 with high sliding properties and high-temperature resistance may be formed on the surface of the contact section 431 as illustrated in FIG. 27. The outer skin 446 may possibly compose a coating layer of a heat resisting film or sheet made of such material as PTFE, PFA, or PI. Namely, the outer skin 446 may improve the sliding properties between the sleeve 12 and the holder 14 when necessary.

Figure 28:
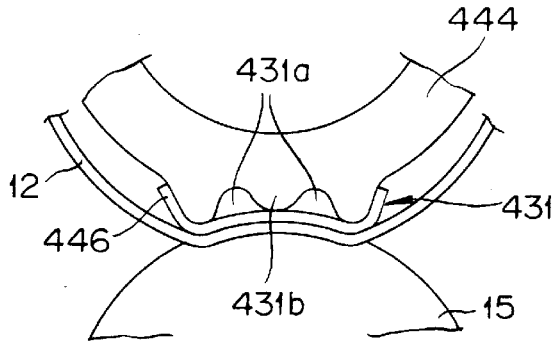
FIG. 28 is enlarged diagram of the essential section of a fixing system wherein a plurality of recesses are formed in a contact section.

Optionally, a plurality of such recesses 431*a* may be disposed as illustrated in FIG. 28. The nip width may be enlarged to the fullest possible extent by increasing the depth of the recess 431a proportionately to the size of the nip width when the pressure roller 15 is a hard roller of a small diameter. The increase of the depth of the recess 431*a*, however, results in largely bending the sleeve 12 inward (the direction of depth of the recess) and increasing the inner stress of the sleeve 12. In contrast, by forming a protrusion 431*b* at the center of the recess or by forming two recesses 431*a*, the sleeve 12 can be supported without excessive bending. As a result, the nip width can be enlarged while the inner stress of the sleeve 12 can be decreased.

Thirteenth Embodiment

Figure 29:
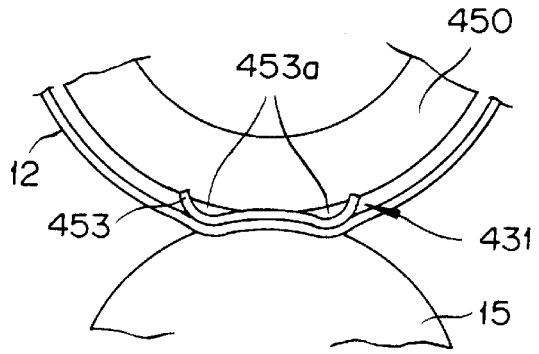
FIG. 29 is an enlarged diagram of the essential section of a fixing system according to the thirteenth embodiment.

FIG. 29 is an enlarged diagram illustrating the essential section of a fixing system according to the thirteenth embodiment. In the diagram, like members found in the eleventh embodiment will be denoted by like reference numerals. The members will be omitted from the following description.

In the thirteenth embodiment, the contact section 431 of a holder 450 is provided with a thin-wall metallic plate 453 and a space 453*a*. The plate 453 is in the shape of a curved surface which has a cross section roughly of a letter W. The space 453*a* is formed between a metallic plate 453 and the holder 450. In these respects, the thirteenth embodiment differs from the eleventh embodiment.

The thirteenth embodiment reinforces the stiffness of the holder 450, and reduces the heat transfer to the holder 414 arising from contacting by means of the space 453*a*. The embodiment also enjoys improved thermal efficiency. Because the metallic plate 453 also rises in temperature by induction heating. An outer skin with high sliding properties and high-temperature resistance is preferably coated on the surface of the metallic plate 453. A lubricant such as grease or oil may be coated on the central recess or the edge region of the metallic plate 453, similarly in the twelfth embodiment.

The entire disclosures of Japanese Patent Application No. 08-230997 filed on Aug. 30, 1996, Japanese Patent Application No. 08-229906 filed on Aug. 30, 1996, Japanese Patent Application No. 08-229907 filed on Aug. 30, 1996, and Japanese Patent Application No. 08-229909 filed on Aug. 30, 1996 each including specification, claims, drawings and summary are incorporated herein by reference in its entirely.

What is claimed is:

1. A heating device comprising:

a sleeve made of an electrical conductive material; and an electromagnet having a coil and a core;

wherein said heading device satisfies the following formulas (1) and (2), $$S1+S2 \geqq 0.3 \times S3 \quad (1)$$

$$0.2 \leqq S2/(S1+S2) \leqq 0.8 \quad (2)$$

wherein S1 is cross sectional area of said core, S2 is cross sectional area of said coil, and S3 is cross sectional area defined by an internal surface of said sleeve.

2. A heating device as in claim 1 further comprising:

a holder having a sleeve-like shape and made of dielectric material, said holder being provided in said sleeve to contact at a region of said internal surface of said sleeve, and said holder accommodates said electromagnet therein, wherein said heating device further satisfies the following formula (3), $$1\ \text{mm} \leqq \text{Dmax} \leqq 5\ \text{mm} \quad (3)$$

wherein Dmax is the maximum distance formed between said holder and said internal surface of said sleeve.

3. A heating device as in claim 1, further comprising a holder which holds said electromagnet.

4. A heating device as in claim 3, wherein said holder is made of a thermosetting resin.

5. A heating device as in claim 4, wherein said holder is hardened.

6. A heating device as in claim 5, wherein said sleeve is heated to a predetermined temperature by an induction heat of said electromagnet, and said holder is hardened in a temperature higher than said predetermined temperature.

7. A heating device as in claim 3, wherein said holder is made of a fiber reinforced resin.

8. A heating device as in claim 3, wherein said holder integrally holds said core and said coil.

9. A heating device as in claim 3, wherein said holder has a region which is in contact with said internal surface of said sleeve.

10. A heating device as in claim 9, wherein said sleeve relatively rotates around said holder.

11. A heating device as in claim 10, wherein said region of said holder is made of a low frictional material.

12. A heating device as in claim 1, wherein said sleeve relatively rotates around said electromagnet.

13. A heating device comprising:

a sleeve made of an electrical conductive material;

an electromagnet having a coil and a core; and a holder including a first portion and a second portion, said first portion being for electrically insulating said coil from said core and being located between said coil and core, said second portion being for electrically insulating said electromagnet from said sleeve and being located between said electromagnet and said sleeve, said first portion and said second portion being formed as a single member.

14. A heating device as in claim 13, wherein said holder having a region which is in contact with said sleeve.

15. A heating device as claimed in claim 14, wherein said holder is in contact with an internal surface of said sleeve.

16. A heating device as claimed in claim 13, wherein said holder is in contact with an internal surface of said sleeve.

17. A heating device comprising:

a sleeve made of an electrical conductive material;

an electromagnet having a coil and a core; and a holder for electrically insulating said coil from said core and said electromagnet from said sleeve, said holder including, a base having an arcuate cross section, and a pair of plates formed on the base, said base and pair of plates being formed as a single member with the core positioned on the base and between the pair of plates.

18. A heating device comprising:

a sleeve made of an electrical conductive material;

an electromagnet having a coil and a core; and an insulating member for electrically insulating said coil from said core and said electromagnet from said sleeve, said insulating member being formed by integrally molding the core and the coil.

* * * * *

UNITED STATES PATENT AND TRADEMARK OFFICE

CERTIFICATE OF CORRECTION

PATENT NO. : 5,870,660

DATED : February 9, 1999

INVENTOR(S) : Tetsuro ITO, et al.

It is certified that error appears in the above-identified patent and that said Letters Patent is hereby corrected as shown below:

Col. 28; line 7: Delete "holder having" and insert --Second portion has--.

Col. 28; line 9: Delete "holder" and insert --region--.

Signed and Sealed this

Third Day of August, 1999

*Attest:*

Q. TODD DICKINSON

*Attesting Officer*

*Acting Commissioner of Patents and Trademarks*